US011101568B1

(12) United States Patent
Wakui et al.

(10) Patent No.: US 11,101,568 B1
(45) Date of Patent: Aug. 24, 2021

(54) ANTENNA WITH DIRECTIONAL GAIN

(71) Applicant: HARADA INDUSTRY OF AMERICA, INC., Novi, MI (US)

(72) Inventors: Masashi Wakui, Novi, MI (US); Antony Mihalopoulos, Saline, MI (US)

( * ) Notice: Subject to any disclaimer, the term of this patent is extended or adjusted under 35 U.S.C. 154(b) by 0 days.

(21) Appl. No.: 16/831,830

(22) Filed: Mar. 27, 2020

(51) Int. Cl.
*H01Q 15/14* (2006.01)
*H01Q 9/26* (2006.01)
*H01Q 1/32* (2006.01)

(52) U.S. Cl.
CPC ..... *H01Q 15/14* (2013.01); *H01Q 1/3275* (2013.01); *H01Q 9/26* (2013.01)

(58) Field of Classification Search
CPC ..... H01Q 15/14; H01Q 9/26; H01Q 1/3275
See application file for complete search history.

(56) References Cited

U.S. PATENT DOCUMENTS 9,116,239 B1 * 8/2015 Billsberry ..... H01Q 21/28
9,263,798 B1 * 2/2016 Piazza ..... H01Q 3/24
10,419,948 B1 * 9/2019 Labadie ..... H01Q 3/005
2015/0061957 A1 * 3/2015 Chung ..... H01Q 15/14 343/797
2015/0236429 A1 * 8/2015 Tanabe ..... H01Q 15/246 455/73
2016/0305392 A1 * 10/2016 Nakamura ..... F02P 5/1502
2018/0205139 A1 * 7/2018 Lin ..... H01Q 1/48
2020/0067180 A1 2/2020 Mizuno et al.
2020/0091615 A1 3/2020 Sone et al.

FOREIGN PATENT DOCUMENTS

JP 2012-054915 3/2012
JP 5722731 5/2015
JP 2019-033328 2/2019
WO 2018/212306 11/2018

* cited by examiner

*Primary Examiner* — Lam T Mai
(74) *Attorney, Agent, or Firm* — Soei Patent & Law Firm

(57) ABSTRACT

An antenna assembly includes a first antenna having a first length in a height direction, and a second antenna including a reflective surface having a second length in the height direction greater than or equal to the first length. The reflective surface of the second antenna is oriented towards a primary signal reception direction of the first antenna, and the reflective surface is configured to reflect a communication signal associated with the first antenna in order to increase a directional gain of the first antenna in the primary signal reception direction.

20 Claims, 28 Drawing Sheets

STAND ALONE ANTENNA

ANTENNA WITH REFLECTOR

REFLECTION FROM 1/2 λ DISTANCE

REFLECTION FROM 1/4 λ DISTANCE

REFLECTION FROM 1λ DISTANCE 212
216
210
215
218
0
30
60
90
-30
-60
-90
5
0
-5
-10
-15
-20

212
210
216
218
215
0
30
60
90
120
150
180
210
240
270
300
330
5
0
-5
-10
-15
-20

219
214W
217D
217
217H
214
211
21D
213H
213
213D
214H
z
y
x
ϕ
θ

ANTENNA WITH DIRECTIONAL GAIN

BACKGROUND

Vehicle-to-everything (V2X) communication is a technology that allows vehicles to communicate with other vehicles, infrastructures, and pedestrians to improve safety, energy/fuel efficiency and traffic flow. V2X can be based on V2X radio technology, cellular based V2X technology (CV2X) or other types of related technologies that provide communication via wireless signals.

A vehicle equipped with V2X technology may contain an onboard communication module and an antenna. The onboard module transmits information about the vehicles speed, direction, position, etc. The V2X antenna may be placed on top of the vehicle or in the passenger cabin. However, V2X antennas placed on roofs may not be able to provide complete 360-degree coverage around the vehicle. Other types of vehicle antennas may experience similar limitations.

The location and number of antennas that are placed on a vehicle may be limited for additional reasons. For example, an antenna may be placed in the windshield of the vehicle, however this space is already becoming crowded with other items such as front mounted cameras, rain sensors, heating elements, etc., and the available space is expected to decrease further with the adoption of autonomous vehicles.

Antenna assemblies may comprise a plurality of components. As the number and complexity of the components increase, the available room within the antenna housing may be limited, resulting in component interference or performance degradation. Additionally, the size, shape and specifications of the antenna assembly may be constrained by regional and international regulations.

These and other problems are addressed in the present application.

SUMMARY

Disclosed herein is an example antenna assembly with directional gain. The antenna assembly may include a first antenna having a first length in a height direction. Additionally, the antenna assembly may include a second antenna including a reflective surface having a second length in the height direction, greater than the first length. The reflective surface of the second antenna is oriented towards a primary signal reception direction of the first antenna. The reflective surface is configured to reflect a communication signal associated with the first antenna in order to increase a directional gain of the first antenna in the primary signal reception direction.

Additionally disclosed herein is an example antenna assembly with directional gain, including a first antenna having a first length in a height direction. The first antenna is configured to receive a first communication signal having a first frequency. The antenna assembly also includes a second antenna including a reflective surface having a second length in the height direction equal to or greater than the first length. The second antenna is configured to receive a second communication signal having a second frequency which is lower than the first frequency. The reflective surface of the second antenna is oriented towards a primary signal reception direction of the first antenna. The reflective surface is configured to reflect the first communication signal in order to increase a directional gain of the first antenna in the primary signal reception direction.

DETAILED DESCRIPTION

In the following description, with reference to the drawings, the same reference numbers are assigned to the same components or to similar components having the same function, and overlapping description is omitted.

V2X antennas are used by vehicles to communicate with other vehicles, infrastructures, pedestrians, etc. in order to prevent accidents, ease traffic congestion, and assist vehicle occupants with services such as quick access to available parking, and to provide other services. The V2X operating frequency is currently 5.85 to 5.925 GHz in the USA, and many other countries similarly have designated ranges of operating frequencies.

There are a number of technologies that can be used for V2X, including Dedicated Short Range Communication (DSRC) and C-V2X. Regardless of the technology selected, the same frequency spectrum will typically be used within any given country. In order to obtain a good omnidirectional radiation pattern, two or more antennas may be used to cover the area around the vehicle. For example, two or more antenna assemblies may be separately mounted on the side, front, rear, top, spoiler, bumper, mirror, window, etc. of the vehicle.

Vehicles may be equipped with additional types of antennas. For example, cellular antennas may be used to communicate with cellular towers in order to facilitate communication with infrastructures or with other cellular devices outside the vehicles. Cellular antennas for vehicles may be configured to cover bandwidths for Fourth Generation/Long Term Evolution (4G/LTE) networks, as well as Fifth Generation (5G) networks, which may include bandwidths of 6 GHz and beyond.

Figure 1:
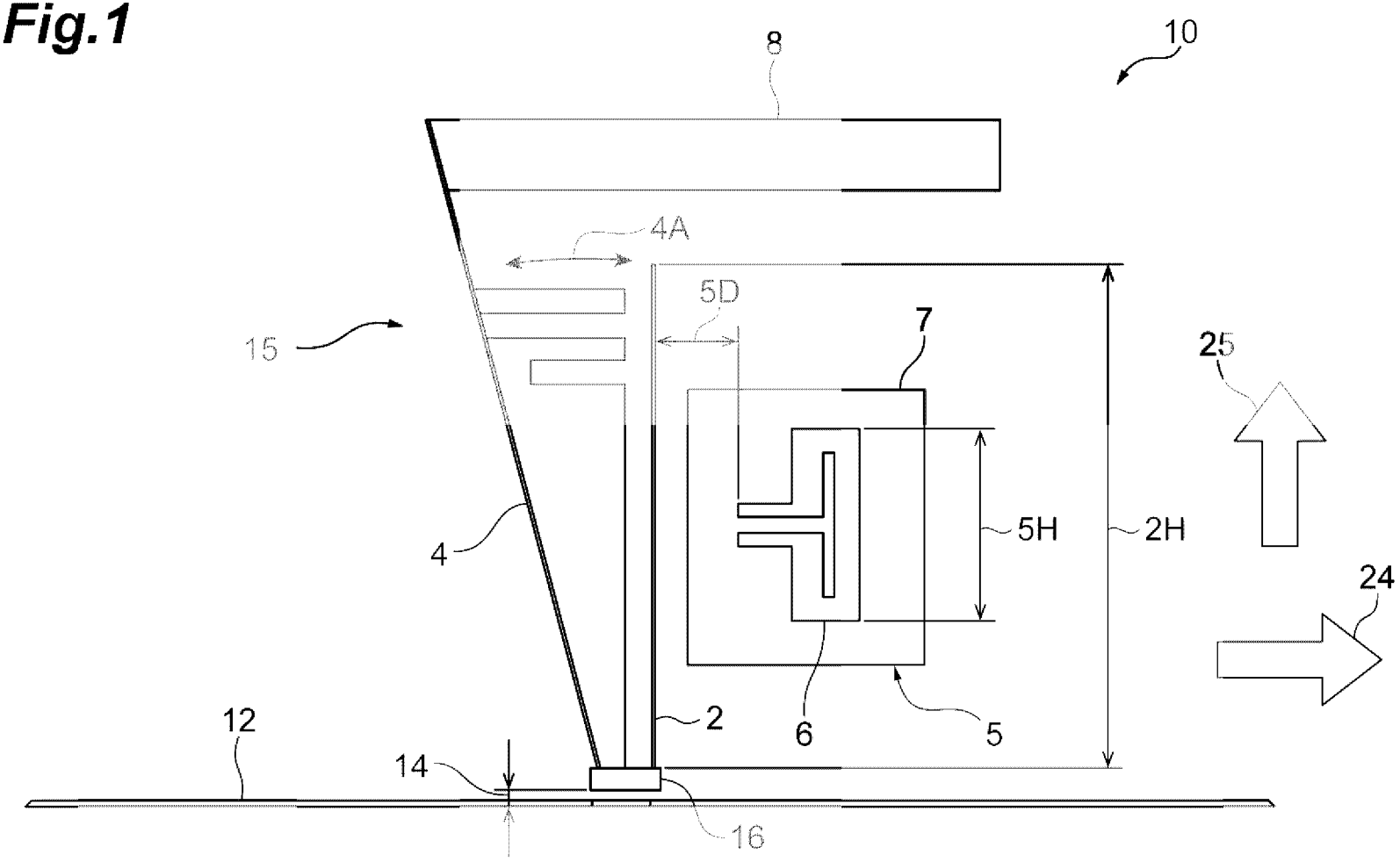
FIG. 1 illustrates an example antenna assembly.

FIG. 1 illustrates an example antenna assembly 10 including a first antenna 5 and a second antenna 15. The first antenna 5 has a first length 5H in a height direction 25, and is configured to receive a first communication signal having a first frequency. The second antenna 15 includes a reflective surface 2 having a second length 2H in the height direction 25 equal to or greater than the first length 5H. In some examples, the length 2H of the reflective surface 2 is between 30 mm to 50 mm. Additionally, the second antenna 15 is configured to receive a second communication signal having a second frequency which is lower than the first frequency.

In some examples, the first antenna 5 may include a V2X antenna, and the second antenna 15 may include a resonance antenna, a radio antenna, a telecommunications antenna, or a digital audio broadcast (DAB) antenna. Telecommunications antennas may include 4G or 5G antennas.

The first antenna 5 may include an antenna element 6, such as a folded dipole antenna. The antenna element 6 may be formed on the surface of a vertically oriented antenna substrate 7 oriented in the height direction 25. In some examples, the surface of the antenna substrate 7 is positioned substantially perpendicular to the reflective surface 2. The first length 5H associated with the antenna 5 may include the height of the antenna element 6.

The first communication signal associated with the first antenna 5 may include a primary signal wavelength, and a distance 5D between the first antenna 5 and the reflective surface 2 may be equal to or less than approximately one half of the primary signal wavelength. The distance 5D may be measured in a direction perpendicular to the height direction 25, for example in a reflective direction 24 that is perpendicular to the height direction 25. The distance 5D associated with the antenna 5 may include the distance between the reflective surface 2 and the antenna element 6. In some examples, the distance 5D may be between approximately 13 mm to 26 mm.

The second antenna 15 may comprise a signal receiving body 4 that is offset from the reflective surface 2. The signal receiving body 4 may be offset in the reflective direction 24. In some examples, the signal receiving body 4 may be angularly offset 4A from the reflective surface 2 along a vertically oriented plane formed perpendicular to the reflective surface 2, for example a vertically oriented plane formed by the reflective direction 24 and the height direction 25. The reflective surface 2 may be located between the signal receiving body 4 and the first antenna 5 along the vertically oriented plane. Additionally, the signal receiving body 4 may have a different effective antenna length than the reflective surface 2 so as to form a multiband antenna. For example, the effective antenna length of the signal receiving body 4 may be longer than the effective antenna length of the reflective surface 2.

The reflective surface 2 may be electrically coupled to the signal receiving body 4 at a lower end 16 of the second antenna 15. The lower end 16 may be spaced apart from a ground plane 12 by a gap 14. The gap 14 may function to electrically isolate the second antenna 15 from the ground plane 12. The second antenna 15 may additionally include a second signal receiving body 8 electrically coupled to the signal receiving body 4. In some examples, the second signal receiving body 8 may include an upper signal receiving body that extends over the first antenna 5. In some examples, the lower end 16 may include a lower signal receiving body of the second antenna 15.

Figure 2:
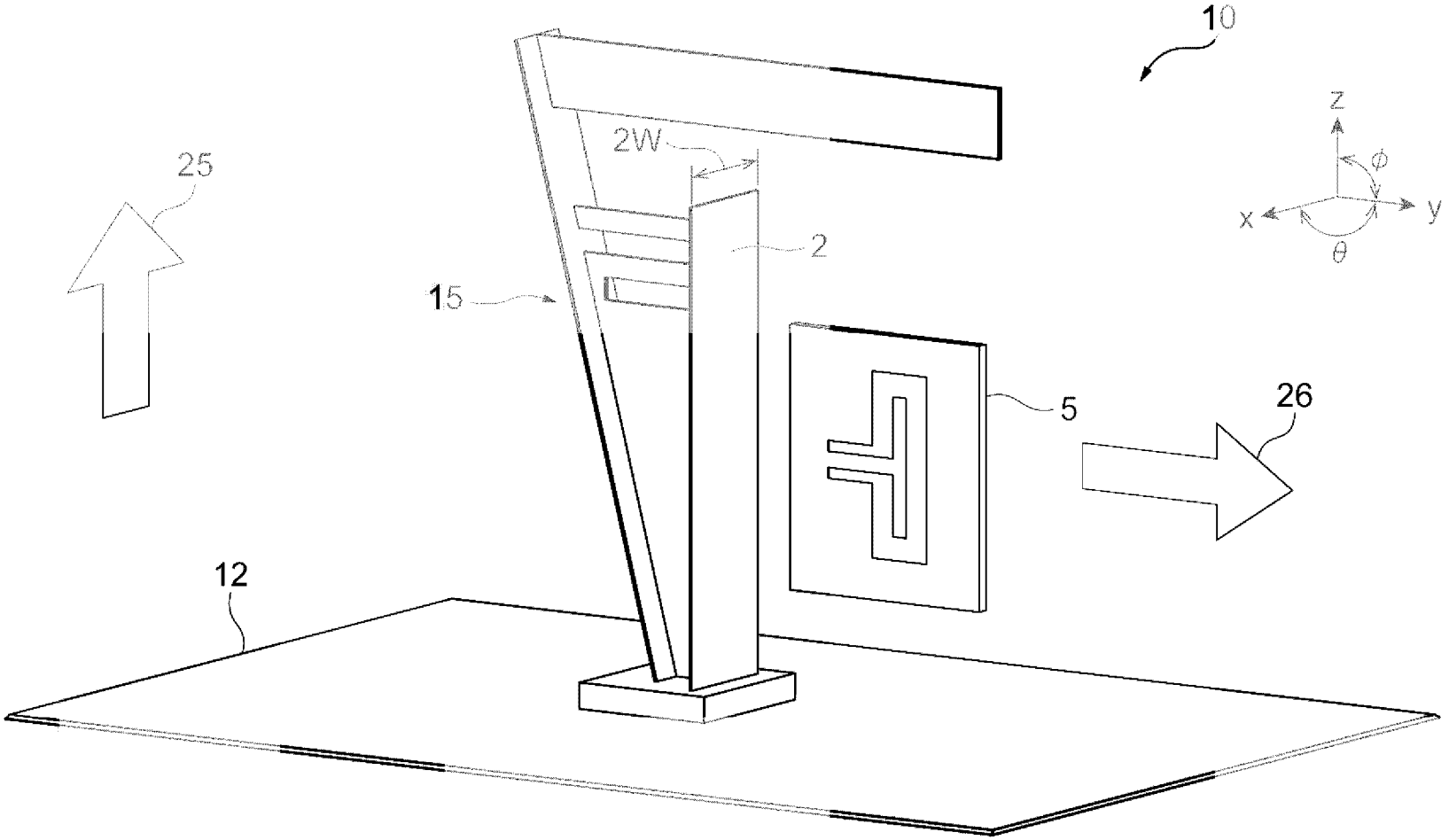
FIG. 2 illustrates an isometric view of the antenna assembly of FIG. 1.

FIG. 2 illustrates an isometric view of the antenna assembly 10 of FIG. 1, in which the reflective surface 2 of the second antenna 15 can be seen oriented towards or facing a primary signal reception direction 26 of the first antenna 5. In some examples, the primary signal reception direction 26 is in the same direction as the reflective direction 24 illustrated in FIG. 1. The reflective surface 2 is configured to reflect the first communication signal in order to increase a directional gain of the first antenna 5 in the primary signal reception direction 26.

The isometric view of FIG. 2 further illustrates a width 2W of the reflective surface 2 in a direction substantially perpendicular to both the height direction 25 and the primary signal reception direction 26. In some examples, the width 2W of the reflective surface 2 is between approximately 10 mm to 25 mm.

The height direction 25 may be taken perpendicular to the surface of the ground plane 12. In some examples, the ground plane 12 may comprise the base of an antenna housing, or a mounting surface of the antenna assembly 10. The ground plane 12 may be understood to be formed by the "x" and "y" coordinates of the example orthogonal system illustrated in FIG. 2. Additionally, the height direction 25 may be understood to be in the illustrated "z" coordinate. Angular coordinates associated with the example orthogonal system may be made with reference to an angle "Θ" between the "x" and "y" coordinates, and an angle "ϕ" between the "y" and "z" coordinates. Stated in another way, angle "Θ" is a rotational angle taken about coordinate "z", and angle "ϕ" is a rotational angle taken about coordinate "x".

Further reference to the "x", "y" and "z" coordinates and the angles "Θ" and "ϕ" made herein, may be understood with respect to the orthogonal system illustrated at FIG. 2. Additionally, the "x-y" plane may alternately be referred to herein as an "H-plane", whereas the "y-z" plane may be referred to herein as an "E-plane".

Figure 3:
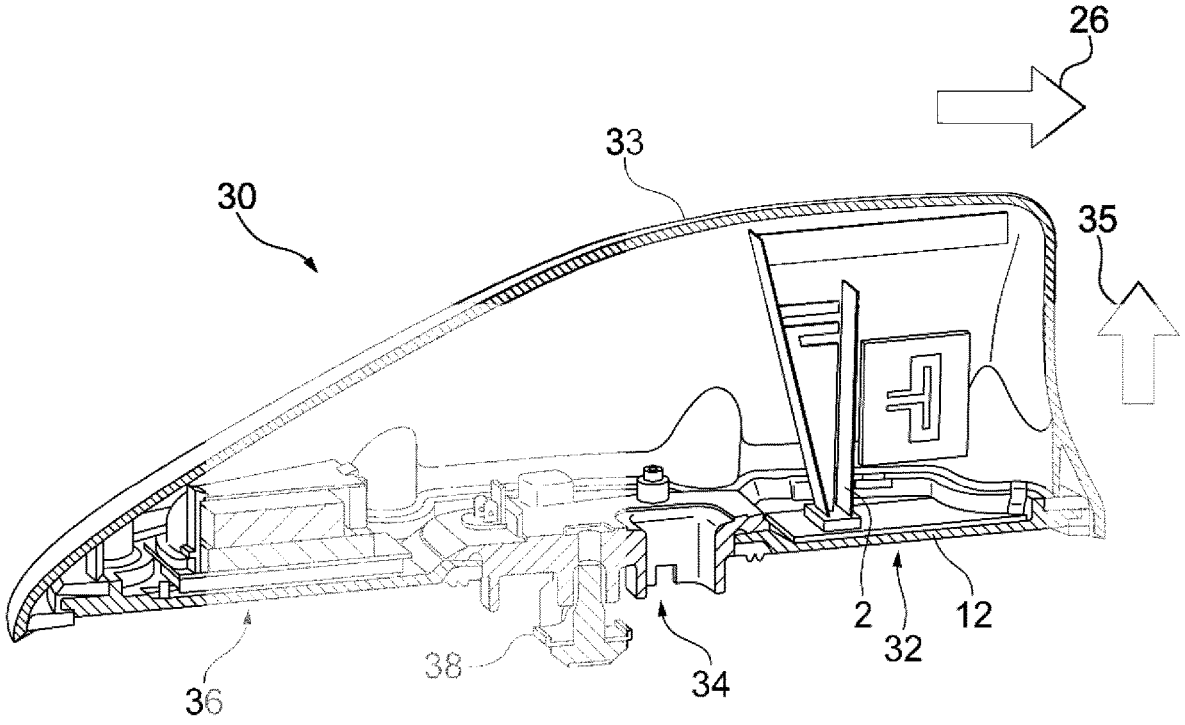
FIG. 3 illustrates an antenna assembly including an antenna housing.

FIG. 3 illustrates an example antenna assembly 30 including an antenna housing 33 associated with a height direction 35. In some examples, the antenna housing 33 may be attached to a vehicle mounting structure, and the height direction 35 may be understood to extend away from the vehicle mounting structure. A maximum vertical clearance of the antenna assembly 30 may be determined with respect to the height of the antenna housing 33 in the height direction 35.

The antenna housing 33 may comprise a first compartment 32 configured to house both the first antenna 5 and the second antenna 15 including the reflective surface 2. The ground plane 12 may be located at the base of the antenna housing 33.

Additionally, the antenna housing 33 may comprise a second compartment 34 and a third compartment 36. The second compartment 34 may be configured to house various media or communication circuitry, and the third compartment 36 may be configured to house one or more additional receivers, such as a global positioning satellite receiver or other type of navigational receiver, for example.

With further reference to FIG. 1, the first length 5H of the first antenna 5 and the second length 2H of the reflective surface associated with the second antenna 15 may be determined with respect to the height direction 35 of the antenna housing 33 illustrated in FIG. 3. In some examples, the second length 2H is greater than the first length 5H in the height direction 35.

The antenna assembly may be configured such that the first antenna 5 is spaced apart from the second antenna 15 in the primary signal reception direction 26 (e.g., the lengthwise direction of the antenna housing 33) so that the radiation pattern of the first antenna 5 is maximized in a rear direction of the vehicle. In some examples, the rear direction corresponds to the primary signal reception direction 26 of the first antenna 5.

Figure 4:
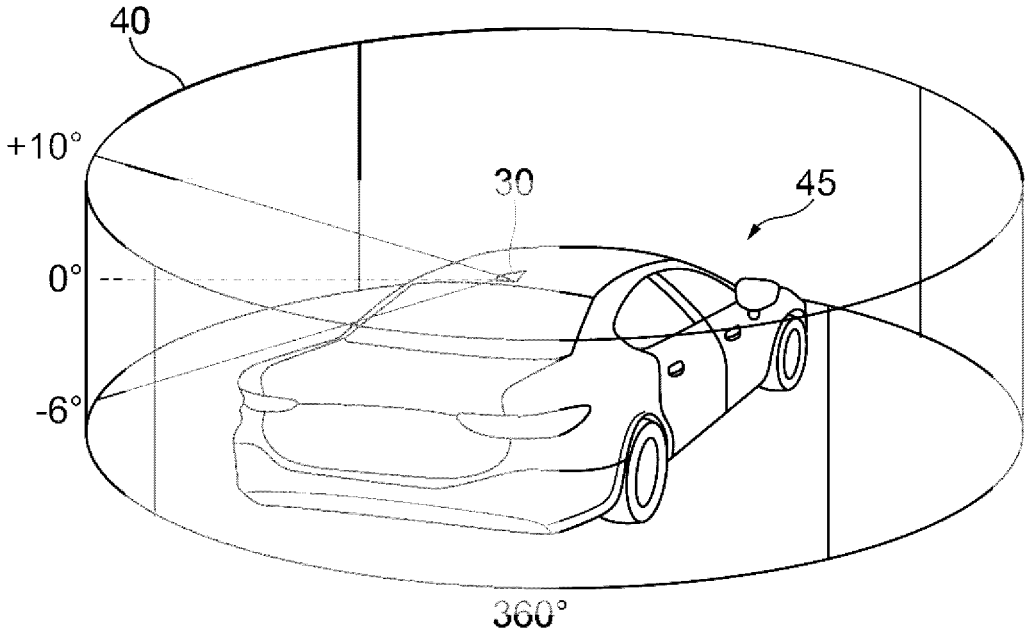
FIG. 4 illustrates the antenna assembly of FIG. 3 mounted to a vehicle.

FIG. 4 illustrates the antenna assembly 30 of FIG. 3 mounted to a vehicle 45. The antenna assembly 30 may be configured to provide a hemispherical-shaped or partial hemispherical-shaped signal reception region 40. In some examples, the reception region may be associated with one or more antenna assemblies. By way of example only, the partial hemispherical-shaped signal reception region 40 may be formed to provide a 360 degree signal reception coverage around the vehicle 45, which may be determined within the range from +10 degrees to −6 degrees from a horizontal plane (0 degrees) that passes through one or more reference points, such as the antenna assembly 30. Other ranges are contemplated herein, for example to accommodate communication with other vehicles, with cell phone towers, with satellite systems, other communication systems, or any combination thereof.

Some types of vehicle communications may be configured to provide signal reception coverage at 360 degrees around the vehicle at a particular elevation or range of elevations. In order to obtain satisfactory performance around 360 degrees, the vehicle may be equipped with more than one antenna. By way of example, one antenna may be placed on the front of the vehicle and another antenna maybe place on the rear of the vehicle. In other examples, one antenna is placed on the right side of the vehicle and another antenna is placed on the left side of the vehicle. In these examples, each antenna may be configured to primarily cover half of the 360 degree radiation pattern area, or 180 degrees.

For antenna assemblies which include multiple antennas within the same antenna housing, the antennas may obstruct the ability of each other to obtain satisfactory signal strength throughout the 360 degree radiation pattern area. However, by configuring each antenna to primarily cover half of the radiation pattern, the interference between antennas within the housing may be mitigated. Additionally, the antennas may be used to enhance the directional gain of each other according to the size, location, and spacing of the antennas relative to each other, and as further described herein.

Figure 5B:
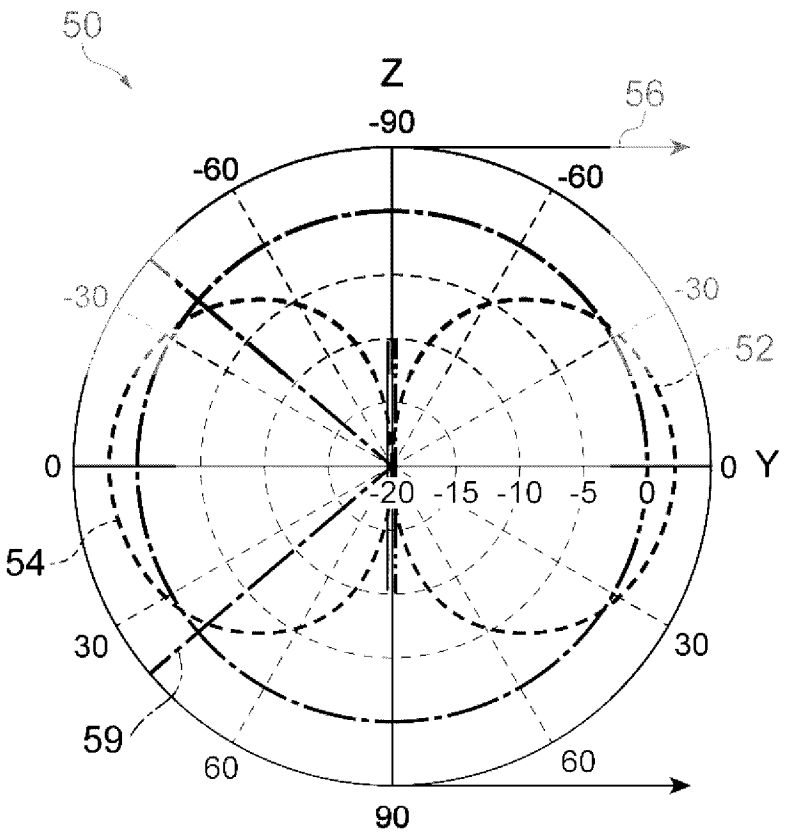
FIG. 5B illustrates the example radiation pattern of FIG. 5A, shown in a second cross-sectional view, normal to the first cross-sectional view.
Figure 5A:
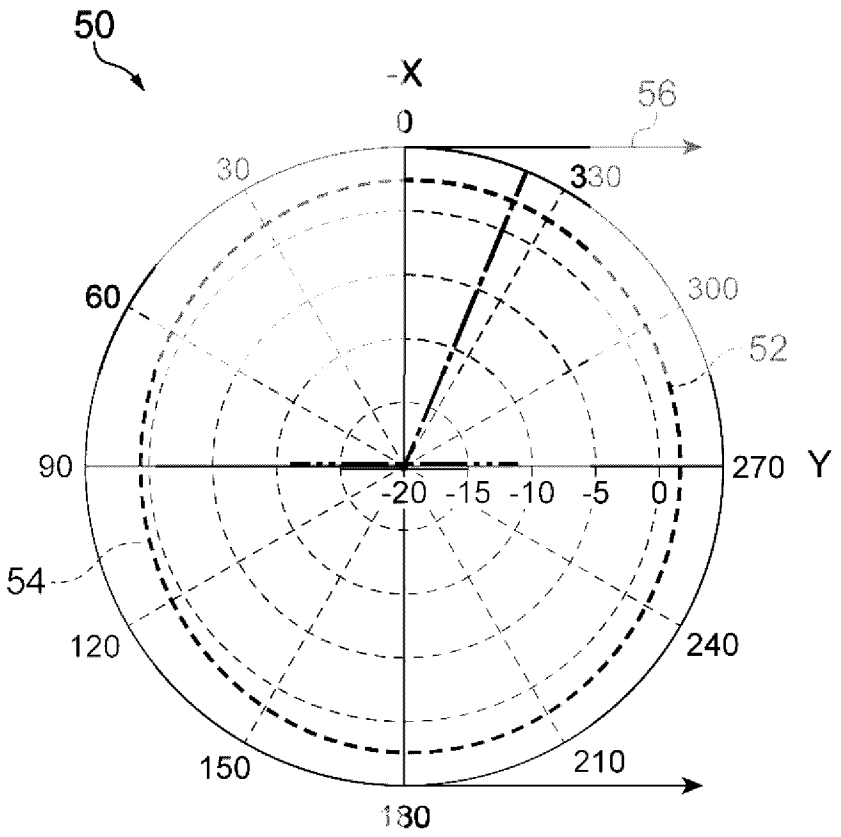
FIG. 5A illustrates an example radiation pattern for an antenna in a first cross-sectional view.

FIG. 5A illustrates an example radiation pattern 50 for an antenna in a first cross-sectional view taken with respect to the "x" and "y" coordinates of the example orthogonal system illustrated at FIG. 2. The radiation pattern 50 may be seen to vary according to an angular position from 0-360 degrees corresponding to the angle "Θ" in the "x-y" plane, or the H-plane. The radiation pattern 50 is for a "stand-alone" antenna, that is, without any other nearby antenna structures or obstructions.

The radiation pattern 50 includes a forward gain 52 in a designated radiation pattern area 56 (e.g., 180 degrees) of the antenna, and a backward gain 54. The radiation pattern 50 for the stand-alone antenna may have a marginally greater forward gain 52 as compared to the backward gain 54. The radiation pattern 50 may be understood to visually illustrate a signal strength of an antenna, as measured in decibels (dB), over the 360 degree view. Additionally, the radiation pattern 50 may be taken at a 0 degree elevation corresponding to angle "ϕ" in the "y-z" plane, or the E-plane.

FIG. 5B illustrates the example radiation pattern 50 of FIG. 5A shown in a second cross-sectional view, taken with respect to the "y" and "z" coordinates of the example orthogonal system illustrated at FIG. 2, normal to the first cross-sectional view. The radiation pattern 50 may be seen to vary according to an angular position from 0-360 degrees corresponding to the angle "ϕ" in the "y-z" plane, or the E-plane.

The forward gain 52 and backward gain 54 form two lobes in the E-plane, with each lobe corresponding to a beam width 59 in the respective designated radiation pattern area 56.

Figure 6B:
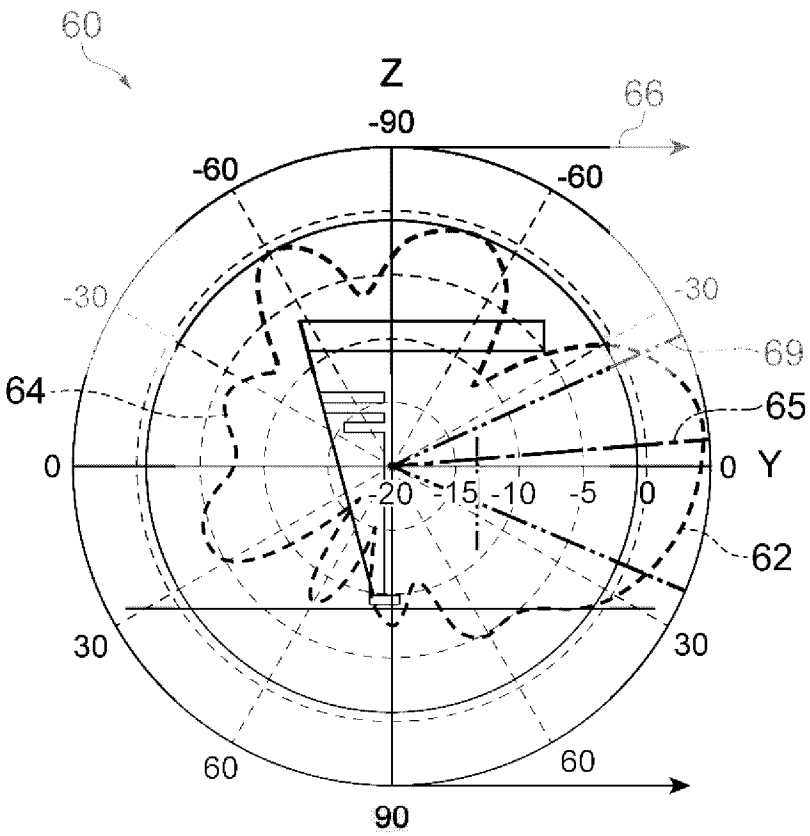
FIG. 6B illustrates the example radiation pattern of FIG. 6A, shown in a second cross-sectional view, normal to the first cross-sectional view.
Figure 6A:
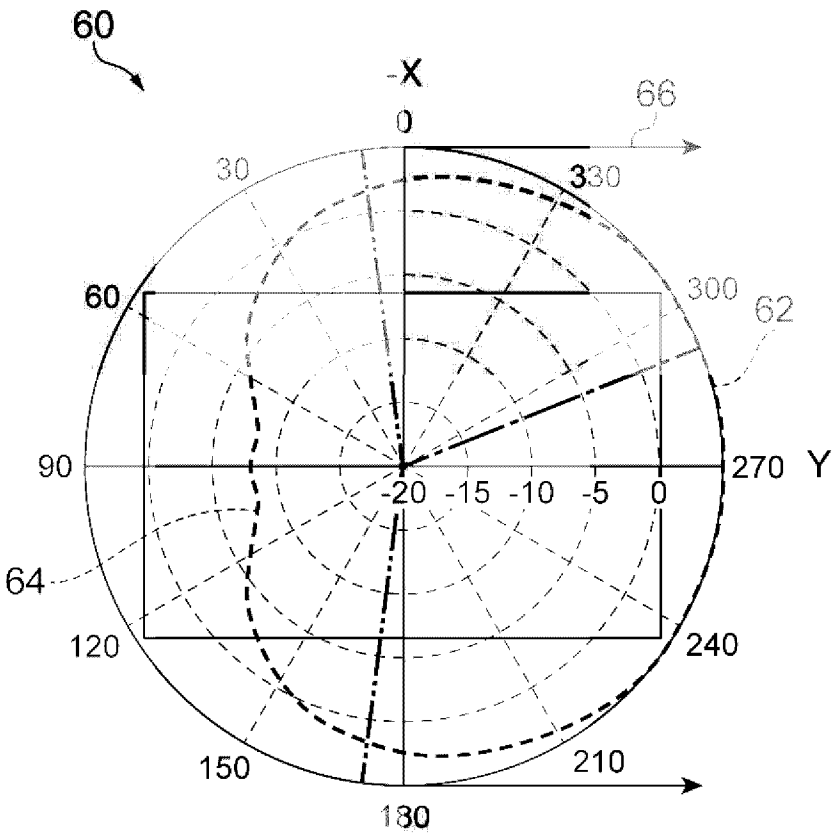
FIG. 6A illustrates an example radiation pattern for an antenna assembly including a reflective surface, in a first cross-sectional view.

FIG. 6A illustrates an example radiation pattern 60 for an antenna assembly including a reflective surface, such as the antenna assembly 10, in a first cross-sectional view taken with respect to the "x" and "y" coordinates of the example orthogonal system illustrated at FIG. 2. The radiation pattern 60 may be seen to vary according to an angular position from 0-360 degrees corresponding to the angle "Θ" in the "x-y" plane, or H-plane.

A designated radiation pattern area 66 for the antenna is from the negative "x" axis to the positive "x" axis, going clockwise, thus passing through the direction of positive "y". The antenna with reflector may be configured to cover half of a 360 degree radiation pattern area, with another antenna that would cover the other half.

In comparing the radiation pattern 60 with the radiation pattern 50 of FIG. 5A, it can be readily seen that a forward gain 62 associated with the radiation pattern 60 is greater than the forward gain 52 associated with the radiation pattern 50. For example, the forward gain 62 may be greater than the forward gain 52 by several decibels (dB).

Additionally, it can be seen that a backward gain 64 associated with the radiation pattern 60 is less than the backward gain 54 associated with the radiation pattern 50. Sill further, the radiation pattern 60 may be seen to have a significantly greater forward gain 62 as compared to the backward gain 64. However, for the antenna with reflector associated with the radiation pattern 60, the reduced backward gain 64 has no direct effect with respect to the performance of the antenna in the designated radiation pattern area 66.

FIG. 6B illustrates the example radiation pattern 60 of FIG. 6A shown in a second cross-sectional view, taken with respect to the "y" and "z" coordinates of the example orthogonal system illustrated at FIG. 2, normal to the first cross-sectional view. The radiation pattern 60 may be seen to vary according to an angular position from 0-360 degrees corresponding to the angle "ϕ" in the "y-z" plane, or E-plane.

As was the case for the first cross-sectional view illustrated in FIG. 6A, the forward gain 62 associated with radiation pattern 60 in the second cross-sectional view is significantly greater as compared to the forward gain 52 associated with radiation pattern 50. For example, the forward gain 62 is greater by several decibels within a beam width 69 in the respective designated radiation pattern area 66. On the other hand, the backward gain 64 may be somewhat decreased as compared to the backward gain 54, at least for certain angular positions.

The forward gain 62 may be at a maximum signal strength along a primary signal reception direction 65 associated with the antenna. The primary signal reception direction 65 may be at an approximately 0 degree elevation in the E-plane, and in some examples may be adjusted toward the positive or negative "z" axis in order to modify the signal reception region 40 (FIG. 4).

Figure 7:
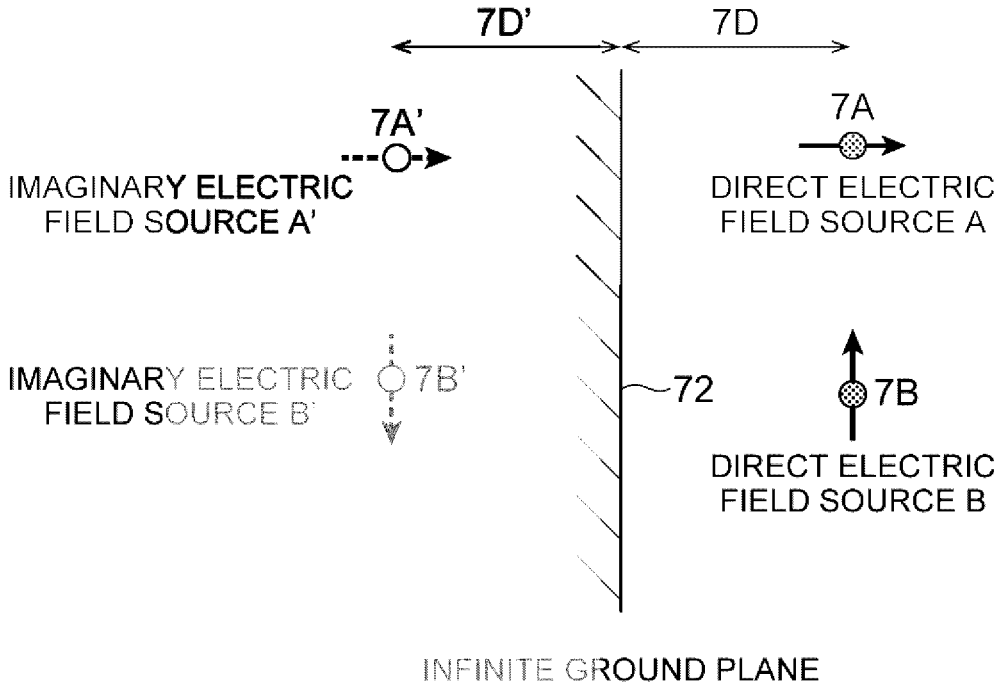
FIG. 7 illustrates a conceptual view of two electrical field sources spaced apart from a ground plane.

FIG. 7 illustrates a conceptual view of two electrical field sources, including a first field source 7A and a second field source 7B, spaced apart from a ground plane 72. One or both of the field sources 7A and 7B may be configured to generate an electric field that reflects against the ground plane 72, such as an infinite ground plane or a conductive E-plane.

The reflection of the electric field may be understood to conceptually create an imaginary additional field source on the other side of the ground plane 72. For example, a first imaginary field source 7A' may correspond to the first field source 7A, and a second imaginary field source 7B' may correspond to the second field source 7B. The imaginary electric field sources will either have a 0 degree phase change from the original field source or 180 degree phase change. In some examples, the first imaginary field source may have a 0 degree phase change (+1) from the first field source 7A, and the second imaginary field source may have a 180 degree phase change (−1) from the second field source 7B.

Figure 8:
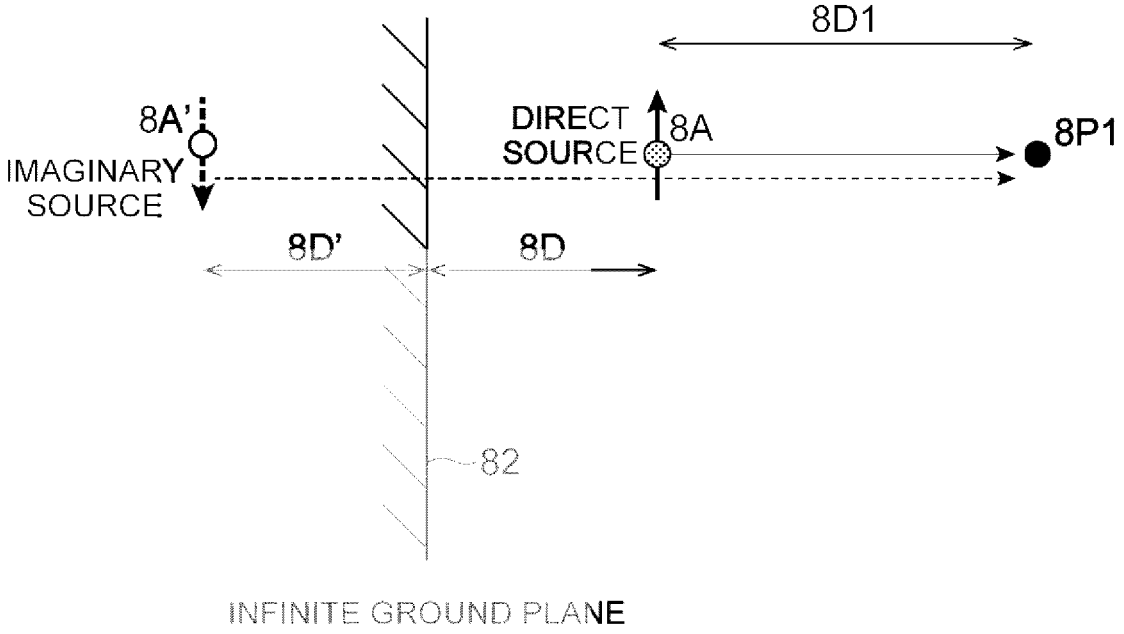
FIG. 8 illustrates a conceptual view of an electrical field source located between a ground plane and a first signal reception point.

FIG. 8 illustrates a conceptual view of an electrical field source 8A located between a ground plane 82 and a first signal reception point 8P1. The electrical field source 8A may be spaced apart from the ground plane 82 by a distance 8D. Additionally, the first signal reception point 8P1 may be spaced apart from the electrical field source 8A by a distance 8D1.

The reflection of the electric field associated with the electrical field source 8A may be understood to conceptually create an imaginary electrical field source 8A' on the other side of the ground plane 82. The imaginary electrical field source 8A' may be spaced apart from the ground plane 82 by a distance 8D'. The distance 8D may equal the distance 8D' in terms of absolute value. The distance 8D1 may be greater than the distance 8D.

Figure 9A:
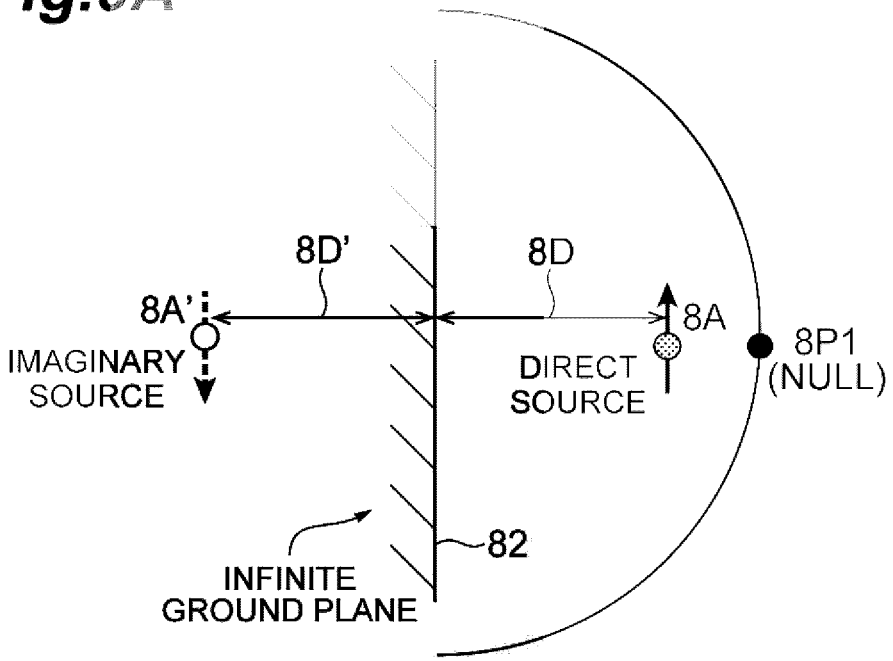
FIG. 9A illustrates a simplified radiation pattern associated with the electrical field source of FIG. 8.

FIG. 9A illustrates a simplified radiation pattern associated with the electrical field source 8A of FIG. 8, in which the electrical field source 8A is placed IA A from the ground plane 82, and the distance 8D1 is greater than A. In some examples, the distance 8D1 may be much greater than A. Additionally, the signal strength or gain at the first signal reception point 8P1 may be null.

Figure 9B:
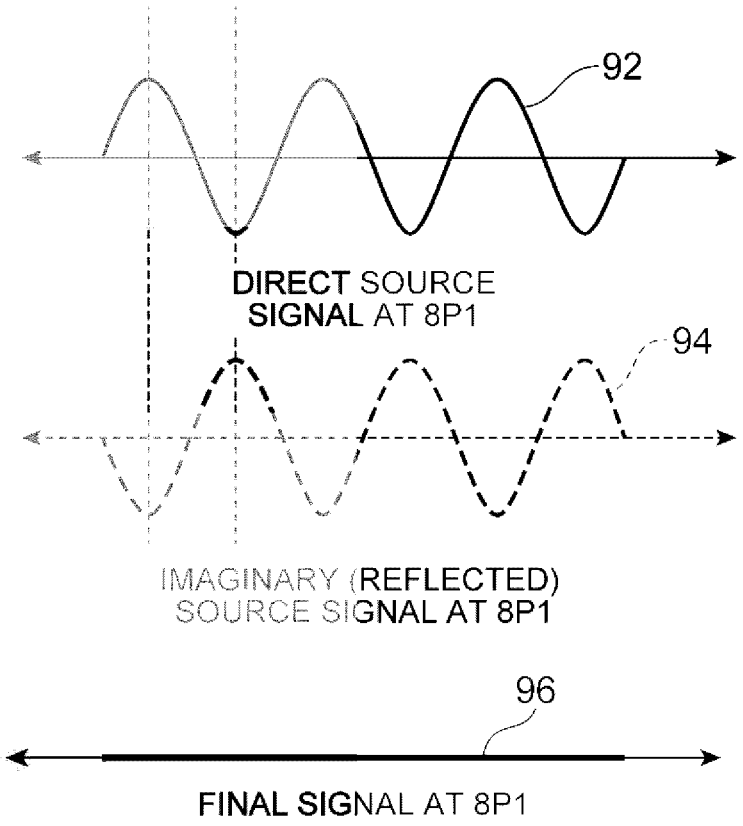
FIG. 9B illustrates the generation of a final signal at the first signal reception point of FIG. 8.

FIG. 9B illustrates the generation of a final signal 96 at the first signal reception point 8P1, with reference to FIG. 9A. The final signal 96 is generated based on the combination of a reflected (or imaginary) signal 94 associated with the imaginary electrical field source 8A' and an original, direct signal 92 associated with the electrical field source 8A.

The reflected signal 94 has to travel 1λ further than the original, direct signal 92 to reach the first signal reception point 8P1, considering that it is initially 180 degrees out of phase. Additionally, the reflected signal 94 associated with the imaginary electrical field source 8A' may be understood to add destructively to the direct signal 92 associated with the electrical field source 8A. Accordingly, the direct and reflected signals may end up approximately 180 degree out of phase, generating a null or insubstantial final signal 96.

Figure 10A:
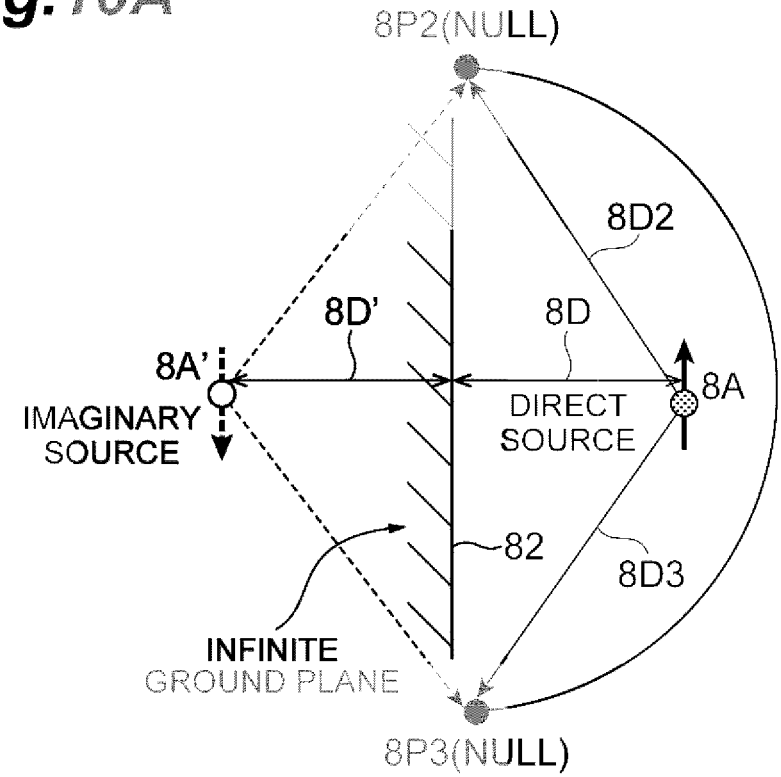
FIG. 10A illustrates a simplified radiation pattern associated with second and third signal reception points corresponding to the electrical field source of FIG. 8.

FIG. 10A illustrates a simplified radiation pattern corresponding to the electrical field source 8A of FIG. 8, and which is associated with a second signal reception point 8P2 and a third signal reception point 8P3. The second and third signal reception points 8P2, 8P3 may be understood as being located adjacent to the ground plane 82.

Again assuming a distance of ½ λ between the electrical field source 8A and the ground plane 82, a distance 8D2 between the electrical field source 8A and the second signal reception point 8P2 may be greater than 1λ, and in some examples much greater than 1λ. Similarly, a distance 8D3 between the electrical field source 8A and the third signal reception point 8P3 may be greater than 1λ. The distance 8D2 associated with the second signal reception point 8P2 may equal the distance 8D3 associated with the third signal reception point 8P3.

Figure 10B:
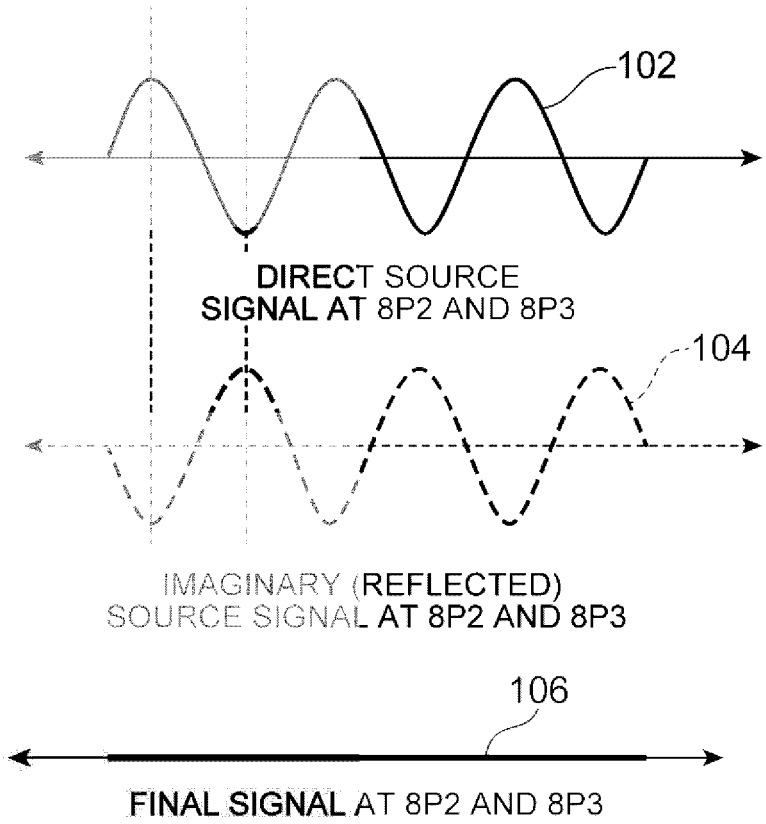
FIG. 10B illustrates the generation of a final signal at the second and third signal reception points of FIG. 10A.

FIG. 10B illustrates the generation of a final signal 106 at the second and third signal reception points 8P2, 8P3 of FIG. 10A. The final signal 106 is generated based on the combination of a reflected (or imaginary) signal 104 associated with the imaginary electrical field source 8A' and an original, direct signal 102 associated with the electrical field source 8A.

In this case, the distance 8D that the direct signal 8A travels and the distance 8D' that the reflected or imaginary source 8A' travels are substantially equal, but they are still 180 degrees out of phase at the second and third signal reception points 8P2, 8P3. In some examples, the reflected signal 104 associated with the imaginary electrical field source 8A' may be understood to add destructively to the direct signal 102 associated with the electrical field source 8A, thereby generating a null or insubstantial final signal 106. Accordingly, it can be seen that at one or both of the second signal reception point 8P2 and the third signal reception point 8P3, there is once again a null value as the final signal 106.

Figure 11A:
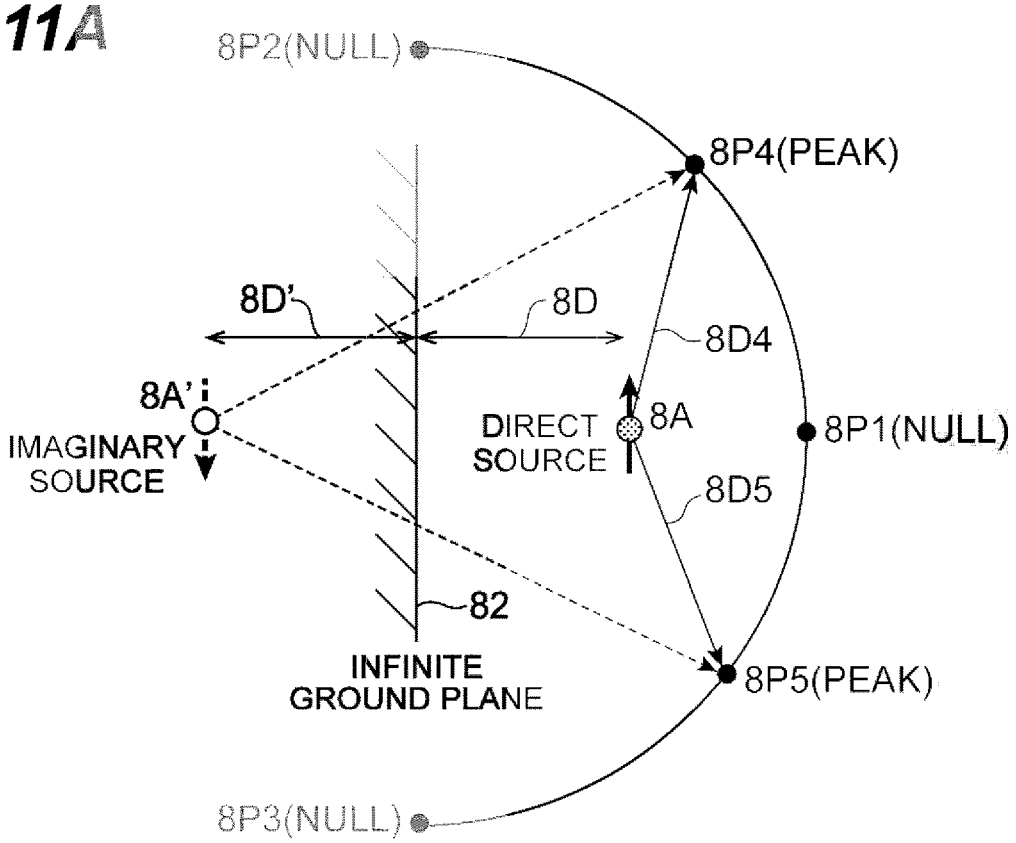
FIG. 11A illustrates a simplified radiation pattern associated with fourth and fifth signal reception points corresponding to the electrical field source of FIG. 8.

FIG. 11A illustrates a simplified radiation pattern corresponding to the electrical field source 8A of FIG. 8, and which is associated with a fourth signal reception point 8P4 and a fifth signal reception point 8P5. The fourth signal reception point 8P4 may be understood as being located halfway between the first signal reception point 8P1 and the second signal reception point 8P2 along an arcuate path. The fifth signal reception point 8P5 may be understood as being located halfway between the first signal reception point 8P1 and the third signal reception point 8P3 along the arcuate path.

Again assuming a distance of ½ λ between the electrical field source 8A and the ground plane 82, the distance 8D4 between the electrical field source 8A and the fourth signal reception point 8P4 may be approximately ½ λ. Similarly, the distance 8D5 between the electrical field source 8A and the fifth signal reception point 8P5 may be approximately ½ λ. In some examples, the distance 8D4 equals the distance 8D5. Additionally, the distance that a reflected signal has to travel from the imaginary electrical field source 8A' to reach either the fourth signal reception point 8P4 or the fifth signal reception point 8P5 is approximately ½ λ than the distance that a direct signal would need to travel from the electrical field source 8A.

Figure 11B:
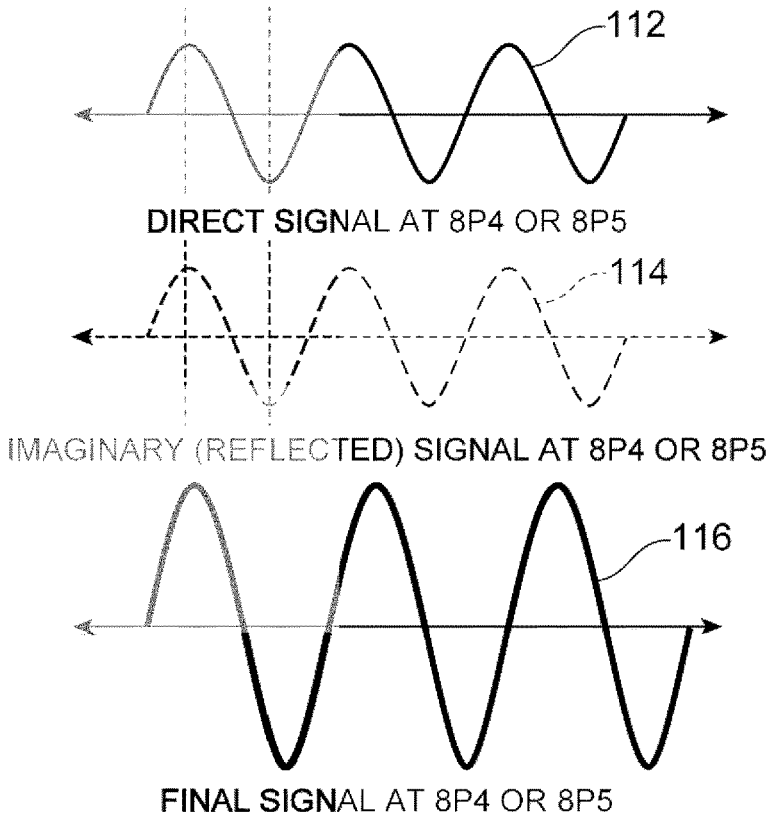
FIG. 11B illustrates the generation of a final signal at the fourth and fifth signal reception points of FIG. 11A.

FIG. 11B illustrates the generation of a final signal 116 at the fourth and fifth signal reception points 8P4, 8P5 of FIG. 11A. The final signal 116 is generated based on the combination of a reflected (or imaginary) signal 114 associated with the imaginary electrical field source 8A' and an original, direct signal 112 associated with the electrical field source 8A.

With reference to FIGS. 9A and 9B, it can be seen that at the first signal reception point 8P1, there is a null value because, in the far field, the reflected signal 94 is shifted by 1λ as compared to the original, direct signal 92. Furthermore, because of the reflection there is a 180 degree shift, which causes a null at the first signal reception point 8P1. In the same way, with reference to FIGS. 10A and 10B, it can be seen that at the second and third signal reception points 8P2, 8P3 there is a difference of 0λ between the electrical field source 8A and the reflected signal 94, which again causes a null due to the 180 degree reflection phase shift.

It can further be seen that in the far field the distance between the electrical field source 8A and the reflected signal 94, 104 will decrease from 1λ at the first signal reception point 8P1, to 0λ at the second signal reception point 8P2 or at the third signal reception point 8P3. This would result in making two signals that add constructively and thereby increase the signal strength in the final signal 116. Accordingly, there is a peak at the fourth and fifth signal reception points 8P4, 8P5.

Figure 12:
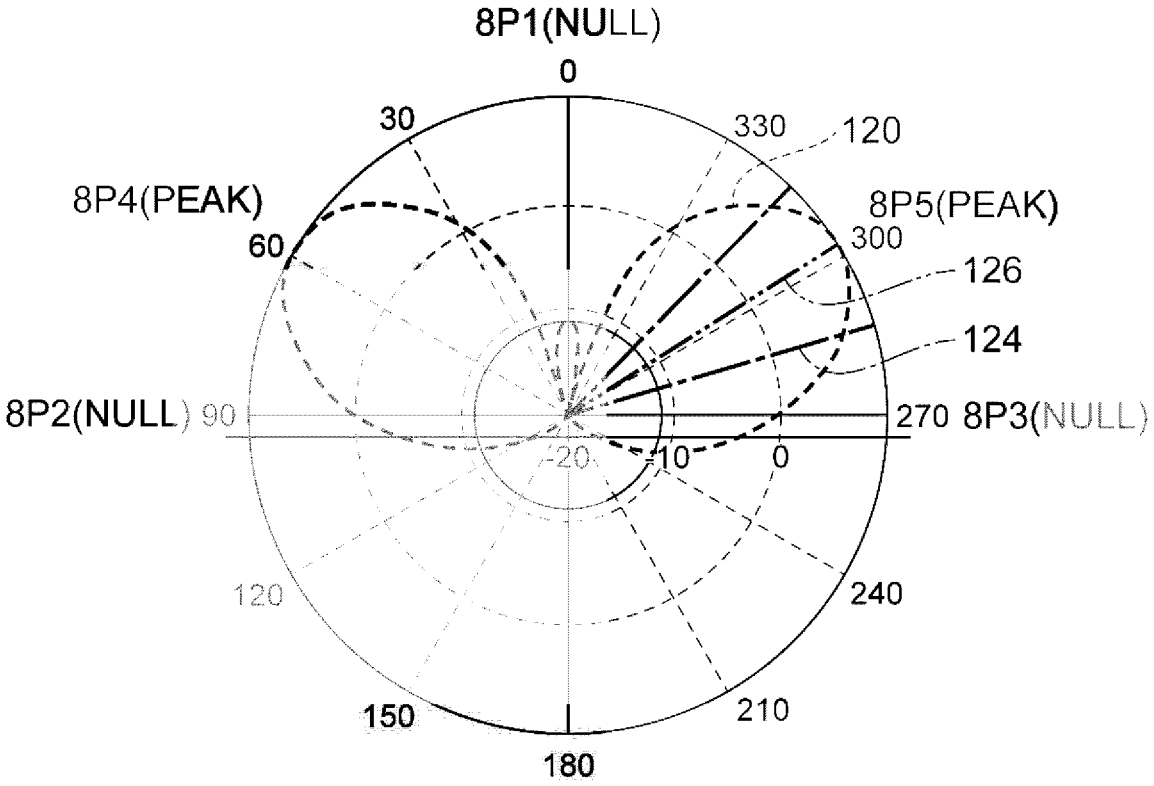
FIG. 12 illustrates a cross-sectional view of an example radiation pattern associated with the electrical field source located a first distance from the ground plane of FIG. 8.

FIG. 12 illustrates a cross-sectional view of an example radiation pattern 120 associated with the electrical field source 8A located a first distance from the ground plane 82 of FIG. 8. In some examples, the first distance, such as distance 8D in FIG. 8, may be approximately ½ λ.

The radiation pattern 120 may be understood to include two peaks at points 8P4, 8P5. The two points 8P4, 8P5 may be symmetrically located in a 180 degree region of interest. In the illustrated example, the two points 8P4, 8P5 are located approximately 60 degrees from a zero-degree reference point. Each peak may correspond to a forward gain 120 which has a maximum or peak value at a primary signal reception direction 126 located within a beam width 124. The beam width 124 may correspond to a certain percentage of the peak value, for example a portion of the radiation pattern 120 which equals at least 90% of the peak value. The primary signal reception direction 126 may be located at an approximate centerline of the beam width 124. In some examples, there may be two or move primary signal reception directions associated with an electrical field source, e.g., an antenna.

In addition to the two peaks at points 8P4, 8P5, three additional points 8P1, 8P2 and 8P3 are identified as a null or insubstantial signal. Point 8P1 is located at zero degrees, and the two other null value points 8P2, 8P3 are located 90 degrees from point 8P1, and 180 degrees from each other. The radiation pattern 120 may be defined or controlled according to the number and locations of the various peaks and/or nulls. For example, the peak(s) may be configured so as to direct the radiation pattern 120 away from the ground plane, e.g., a reflector.

Figure 13:
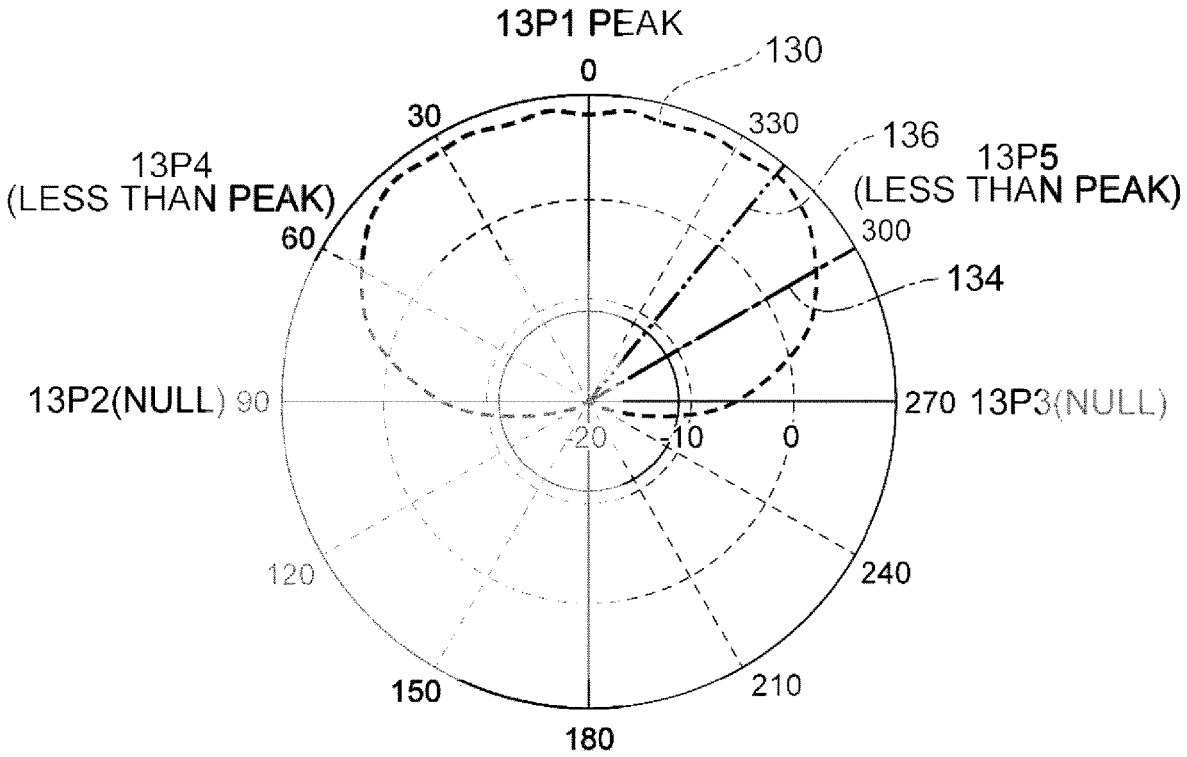
FIG. 13 illustrates a cross-sectional view of an example radiation pattern associated with the electrical field source located a second distance from the ground plane of FIG. 8.

FIG. 13 illustrates a cross-sectional view of an example radiation pattern 130 associated with the electrical field source 8A located a second distance from the ground plane 82 of FIG. 8. In some examples, the second distance, such as distance 8D in FIG. 8, may be approximately ¼ λ.

The signal may be understood to add constructively and have a maximum peak at point 13P1, with null values at points 13P2 and 13P3. In this example, the maximum peak may extend substantially symmetrically on either side of the peak point 13P1, and having a relatively wide beam width 134. For example, the beam width 134 may extend to approximately 60 degrees on either side of the peak point 13P1.

A primary signal reception direction 136 located within the beam width 134 may be associated with the portion of the beam width 134 having the peak value. For example, the primary signal reception direction 136 may correspond to an angular range in which the radiation pattern 130 is substantially equal to the peak value. The beam width 134 may include an additional angular range on either side of the primary signal reception direction 136 in which a portion of the radiation pattern 130 equals some percentage of, or standard deviation from, the peak value. In other examples, the primary signal reception direction 136 may be associated with the approximately centerline of the beam width 134, e.g., the peak point 13P1.

In the radiation pattern 130, it can be seen that there are not any null values within the 180 degree region of interest. For the distance 8D in FIG. 8, the imaginary (reflected) source signal at P1 has to travel ½ λ distance, considering also that it is initially 180 degrees out of phase. The final signal at point 13P1 is obtained by constructive adding, in which there is a maximum signal addition at 13P1.

Comparing the radiation pattern 120 associated with the first distance of ½ λ, to the radiation pattern 130 associated with the second distance of ½ λ, it may be noted that there is a decreased peak value at point 8P1, however the forward gain at 60 degrees is greater for radiation pattern 120. Accordingly, some example antenna assemblies may select a distance 8D between ½ λ and ¼ λ in order to blend the effects of the two radiation patterns 120, 130.

Figure 14A:
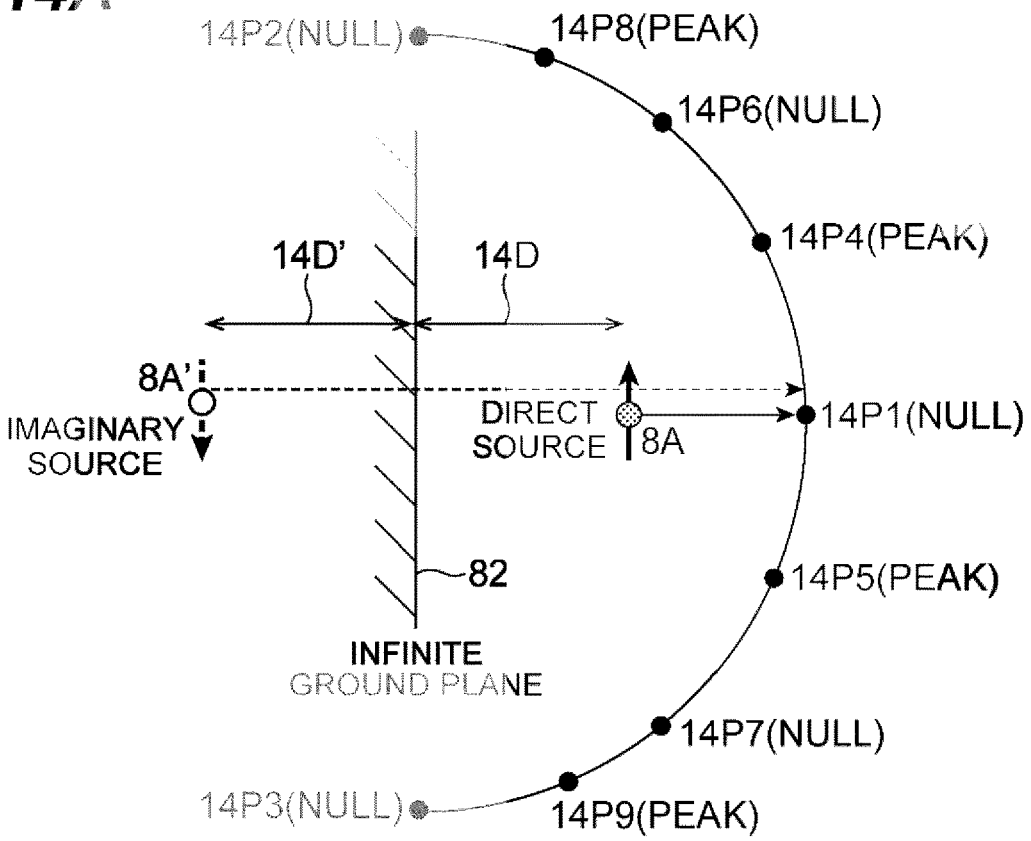
FIG. 14A illustrates a simplified radiation pattern associated with the electrical field source located a third distance from the ground plane of FIG. 8.

FIG. 14A illustrates a simplified radiation pattern associated with the electrical field source 8A of FIG. 8 located a third distance from a ground plane 82. Assuming a distance of 1λ between the electrical field source 8A and the ground plane 82, a first point 14P1 may be located a distance of 1λ from the ground plane 82. Additionally, the radiation pattern 140 may be is associated with second and third reception points 14P2, 14P3 located ninety degrees on either side of the first point 14P1. The first, second and third reception points 14P1, 14P2, 14P3 may be associated with a null or insubstantial value. The distance between the direct and imaginary (reflected) paths may be 2λ at point 14P1, and 0λ at points 14P2, 14P3.

A first set of intermediate points 14P4, 14P6, 14P8 may be located between the first and second points 14P1, 14P2 and may be uniformly spaced apart from each other. Additionally, a second set of intermediate points 14P5, 14P7, 14P9 may be located between the first and third points 14P1, 14P3 and may similarly be uniformly spaced apart from each other. The first and second sets of points may alternate between peak values and null values.

Figure 14B:
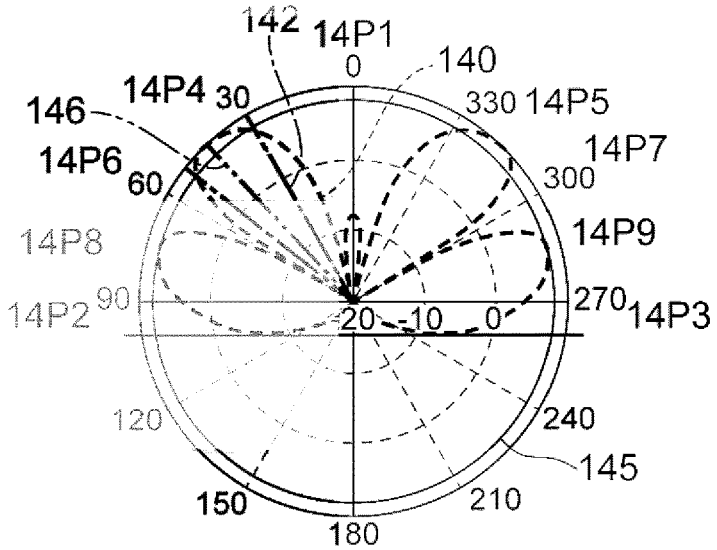
FIG. 14B illustrates a cross-sectional view of an example radiation pattern associated with the electrical field source located at the third distance from the ground plane of FIG. 8.

FIG. 14B illustrates a cross-sectional view of an example radiation pattern 140 associated with the electrical field source 8A of FIG. 8 located at the third distance from the ground plane 82. Between points 14P1 and 14P2 are two peaks at points 14P4 and 14P8, and one additional null at point 14P6. The same situation exists between points 14P1 and 14P3, with two peaks at points 14P5 and 14P9, and one additional null at point 14P7.

A primary signal reception direction 146 and a beam width 142 may be associated with one or more of the peak points 14P4, 14P5. In some examples, one or more of the peaks, such as the peaks at secondary peak points 14P8, 14P9, may be slightly less than the peak values at other points of the radiation pattern, such as peak points 14P4, 14P5. The maximum gain values associated with one or more of the secondary peak points 14P8, 14P9 may be associated with an effective gain 145 of the radiation pattern 140. In some examples, the effective gain 145, or forward gain, may be used to determine the approximate upper and lower boundaries of the beam width 142.

Figure 15C:
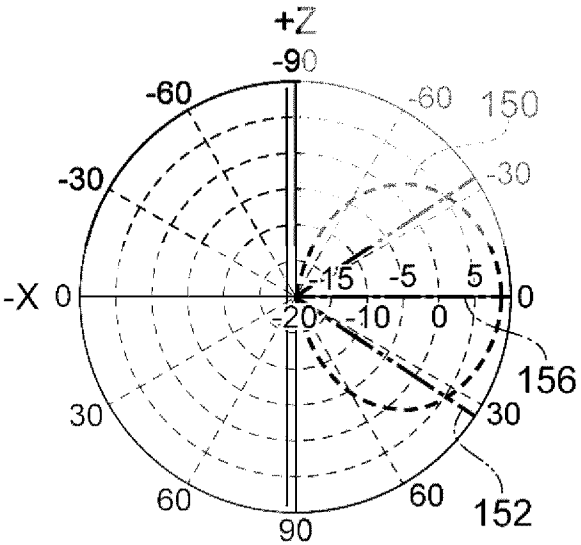
FIG. 15C illustrates the example radiation pattern of FIG. 15B, shown in a second cross-sectional view, normal to the first cross-sectional view.
Figure 15B:
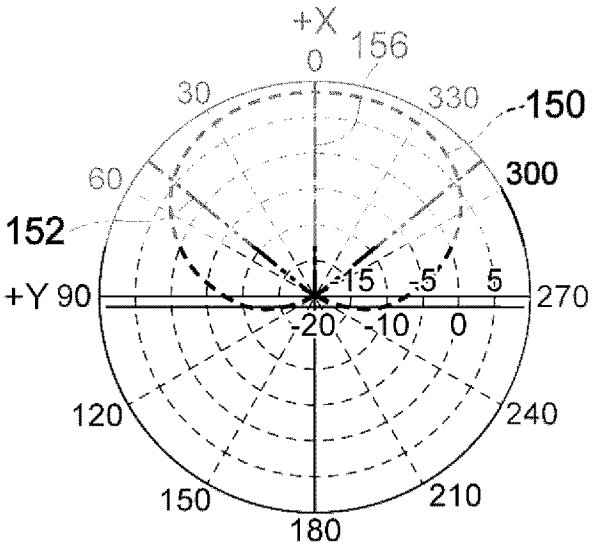
FIG. 15B illustrates an example radiation pattern for an antenna assembly including the reflective surface of FIG. 15A, in a first cross-sectional view.
Figure 15A:
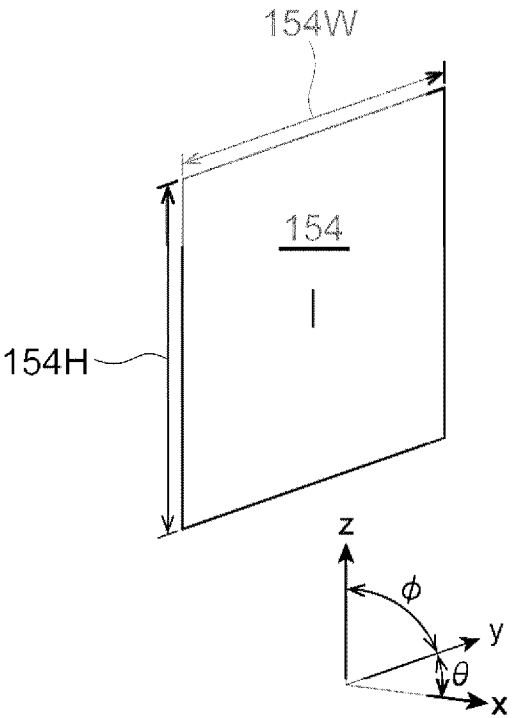
FIG. 15A illustrates an example reflective surface associated with a first width.

FIG. 15A illustrates an example reflective surface 154 associated with a first width 154W and a first height 154H, and FIG. 15B illustrates an example radiation pattern 150 for an antenna assembly including the reflective surface 154 of FIG. 15A, in a first cross-sectional view.

The reflective surface 154 (FIG. 15A) may be configured to face or to be oriented towards a primary signal reception direction 156 (FIG. 15B) corresponding to an antenna, e.g., a first antenna. Additionally, the reflective surface 154 may be configured to reflect a communication signal associated with the first antenna in order to increase a directional gain of the first antenna in the primary signal reception direction 156, or the forward direction of the antenna radiation pattern 150. In some examples, the reflective surface 154 may be part of, or connected to, a second antenna of the antenna assembly.

The radiation pattern 150 may be associated with a forward gain bounded by a beam width 152. The beam width 152 may corresponding to a portion of the radiation pattern 150 which equals a percentage of, or standard deviation from, the peak value of the radiation pattern 150. In other examples, the beam width 152 may correspond to threshold gain value corresponding to a predetermined signal strength of the first antenna, as measured in decibels (dB).

FIG. 15C illustrates the example radiation pattern 150 of FIG. 15B, shown in a second cross-sectional view, normal to the first cross-sectional view. The beam width 152 may have a directional component, such as the primary signal reception direction 156, in both the E-plane and H-plane of the radiation pattern. Additionally, the beam width 152 may have different angular ranges in the two cross-sectional views. In some examples, the angular range associated with the first cross-sectional view of FIG. 15B may be larger than the angular range associated with second cross-sectional view of FIG. 15C.

Figure 16C:
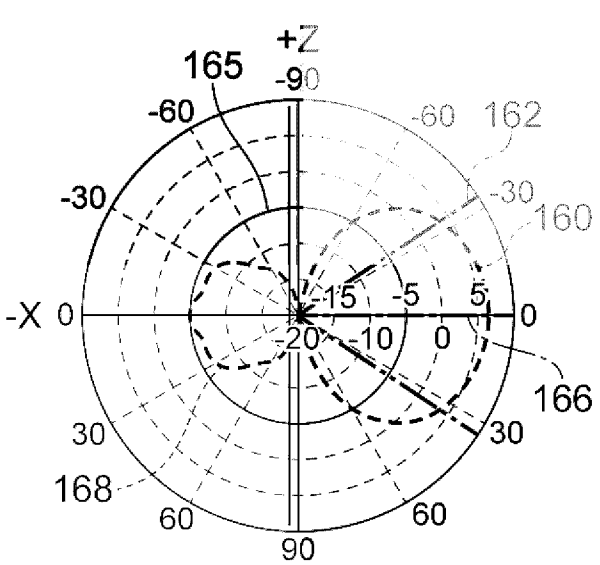
FIG. 16C illustrates the example radiation pattern of FIG. 16B, shown in a second cross-sectional view, normal to the first cross-sectional view.
Figure 16B:
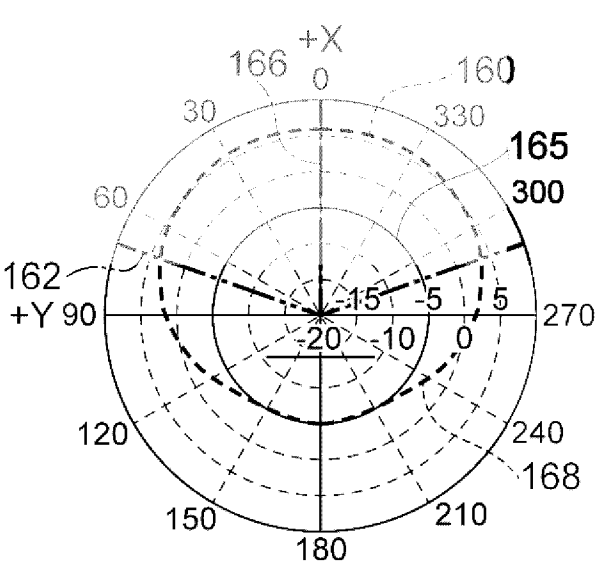
FIG. 16B illustrates an example radiation pattern for an antenna assembly including the reflective surface of FIG. 16A, in a first cross-sectional view.
Figure 16A:
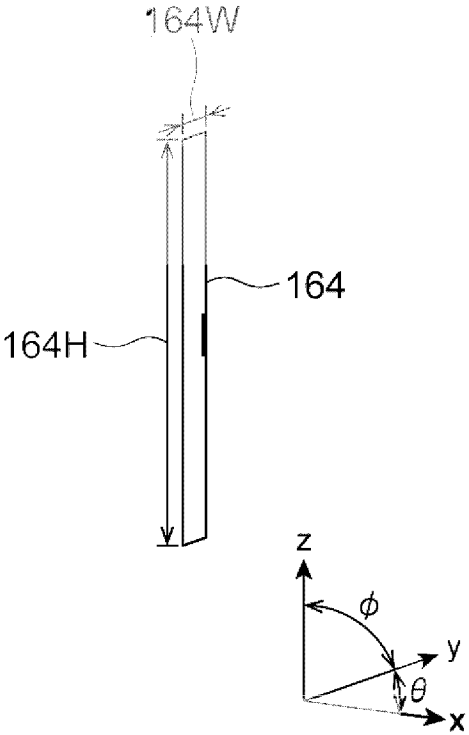
FIG. 16A illustrates an example reflective surface associated with a second width.

FIG. 16A illustrates an example reflective surface 164 associated with a width 164W (second width) and a height 164H (second height). In some examples, the second height 164H may the same height as the first height 154H of FIG. 15A, whereas the second width 164W may be less than the first width 154W.

FIG. 16B illustrates an example radiation pattern 160 for an antenna assembly including the reflective surface 164 of FIG. 16A, in a first cross-sectional view.

Similar to the reflective surface 154 as discussed above with respect to FIG. 15A, the reflective surface 164 may be configured to face or to be oriented towards a primary signal reception direction 166 corresponding to an antenna, e.g., a first antenna. Additionally, the reflective surface 164 may be configured to reflect a communication signal associated with the first antenna in order to increase a directional gain of the first antenna in the primary signal reception direction 166, or the forward direction of the radiation pattern 160. The radiation pattern 160 may be associated with a forward gain bounded by a beam width 162.

By decreasing the second width 164W of the reflective surface 164 as compared to the first width 154W of the reflective surface 154, the performance of the radiation pattern 160 at the side of the reflecting plane in the positive "y" and negative "y" directions can be controlled or modified. For example, with comparison to the radiation pattern 150 illustrated in FIG. 15B, the beam width 162 has a wider angular range than the beam width 152.

A back lobe 168 may be associated with a peak backward gain 165 of the radiation pattern 160 in the backward direction (negative "x"). In the radiation pattern 150, it can be seen that the backward gain (between 90 and 270 degrees) is null or substantially zero. While the peak backward gain 165 of the back lobe 168 may be larger as compared to radiation pattern 150, it can be seen that the forward gain in the primary signal reception direction 166 of the radiation pattern 160 is nevertheless still significantly larger than the peak backward gain 165.

FIG. 16C illustrates the example radiation pattern 160 of FIG. 16B, shown in a second cross-sectional view, normal to the first cross-sectional view.

The beam width 162 may have a directional component, such as the primary signal reception direction 166, in both the E-plane and H-plane of the radiation pattern. Additionally, the beam width 162 may have different angular ranges in the two cross-sectional views. In some examples, the angular range associated with the first cross-sectional view of FIG. 16B may be larger than the angular range associated with second cross-sectional view of FIG. 16C.

As previously discussed, it can be seen that as the second width 164W of the reflective surface 164 is less than the corresponding first width 154W of the reflective surface 154, the back lobe 168 is formed behind the E-plane. The second width 164W of the reflective surface 164 may be reduced until there is only an edge, for example having a width of several millimeters or less and, in some examples, less than one millimeter. Reducing the second width 164W may further increase the beam width 162 in the "x-y" plane, or H-plane (FIG. 16B).

Figure 17C:
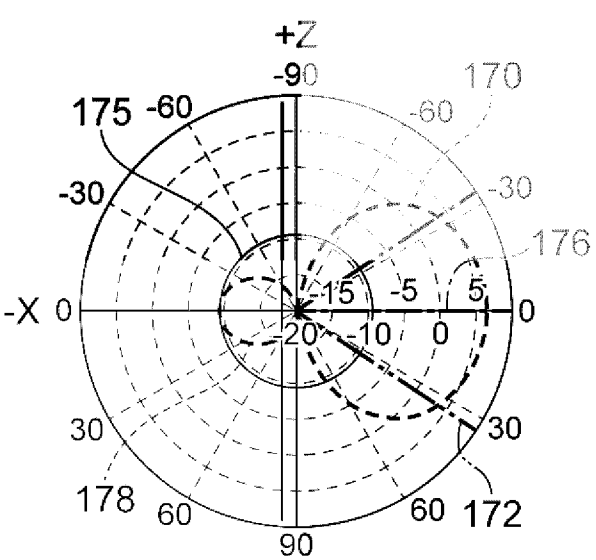
FIG. 17C illustrates the example radiation pattern of FIG. 17B, shown in a second cross-sectional view, normal to the first cross-sectional view.
Figure 17B:
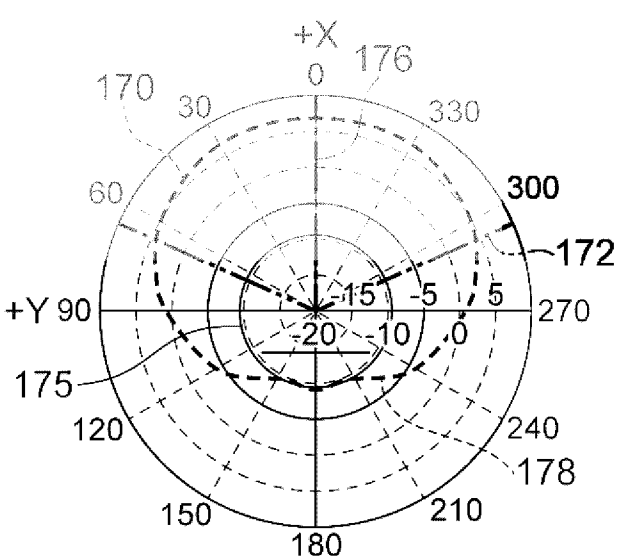
FIG. 17B illustrates an example radiation pattern for an antenna assembly including the reflective surface of FIG. 17A, in a first cross-sectional view.
Figure 17A:
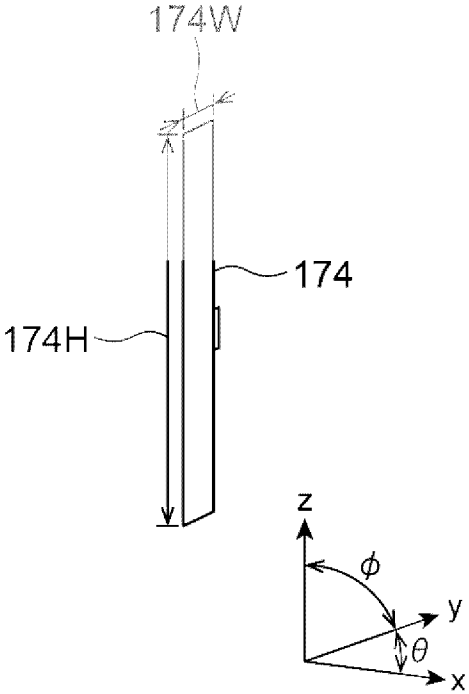
FIG. 17A illustrates an example reflective surface associated with a first height.

FIG. 17A illustrates an example reflective surface 174 associated with a height 174H (first height) and a width 174W (first width), and FIG. 17B illustrates an example radiation pattern 170 for an antenna assembly including the reflective surface 174 of FIG. 17A, in a first cross-sectional view.

The reflective surface 174 may be configured to face or to be oriented towards a primary signal reception direction 176 corresponding to an antenna, e.g., a first antenna. Additionally, the reflective surface 174 may be configured to reflect a communication signal associated with the first antenna in order to increase a directional gain of the first antenna in the primary signal reception direction 176, or the forward direction of the antenna radiation pattern 170. In some examples, the reflective surface 174 may be part of, or connected to, a second antenna of the antenna assembly.

The radiation pattern 170 may be associated with a forward gain bounded by a beam width 172. The beam width 172 may corresponding to a portion of the radiation pattern 170 which equals a percentage of, or standard deviation from, the peak value of the radiation pattern 170. In other examples, the beam width 172 may correspond to threshold gain value corresponding to predetermined signal strength of the first antenna, as measured in decibels (dB).

FIG. 17C illustrates the example radiation pattern 170 of FIG. 17B, shown in a second cross-sectional view, normal to the first cross-sectional view.

The beam width 172 may have a directional component, such as the primary signal reception direction 176, in both the E-plane and H-plane of the radiation pattern. Additionally, the beam width 172 may have different angular ranges in the two cross-sectional views. In some examples, the angular range associated with the first cross-sectional view of FIG. 17B may be larger than the angular range associated with second cross-sectional view of FIG. 17C.

Figure 18C:
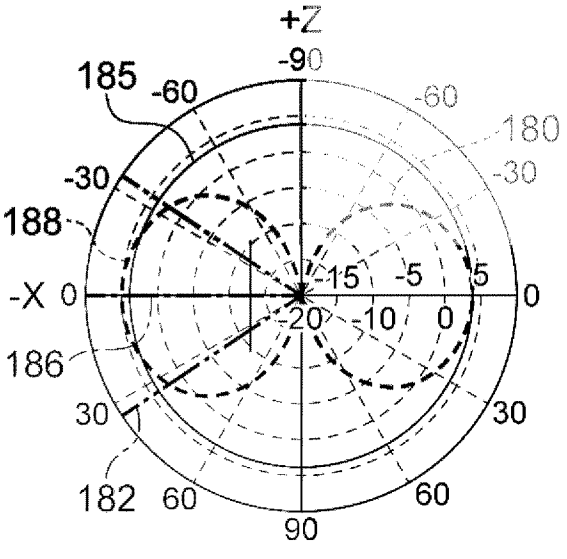
FIG. 18C illustrates the example radiation pattern of FIG. 18B, shown in a second cross-sectional view, normal to the first cross-sectional view.
Figure 18B:
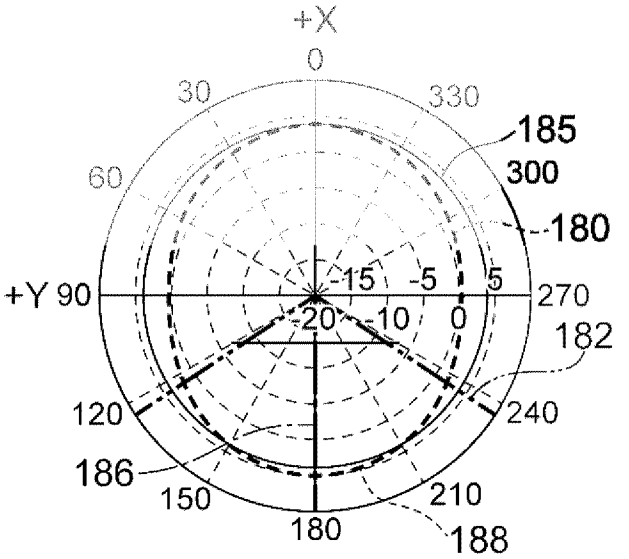
FIG. 18B illustrates an example radiation pattern for an antenna assembly including the reflective surface of FIG. 18A, in a first cross-sectional view.
Figure 18A:
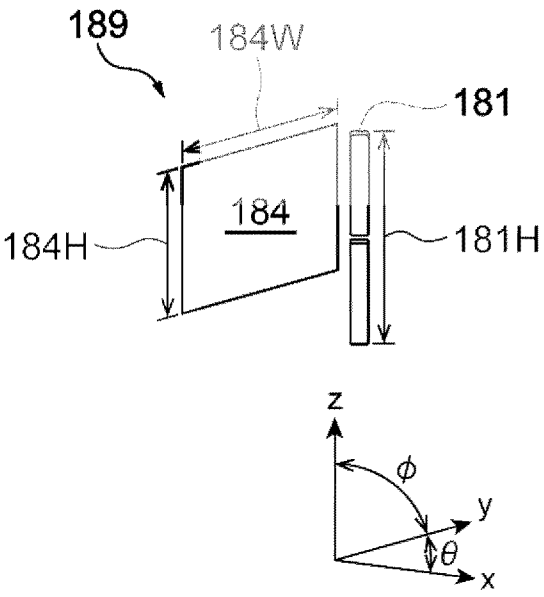
FIG. 18A illustrates an example reflective surface associated with a second height.

FIG. 18A illustrates an example antenna assembly 189 including an antenna 181 and a reflective surface 184 associated with a width 184W (second width) and a height 184H (second height). In some examples, the second width 184W may be the same width as the first width 174W of FIG. 17A, whereas the second height 184H may be less than the second height 174H. Additionally, the second height 184H may be approximately equal to an antenna height 181H associated with the antenna 181 (first antenna). In some examples, the second height 184H of the reflective surface 184 may be less than the antenna height 181H.

FIG. 18B illustrates an example radiation pattern 180 for an antenna assembly including the reflective surface of FIG. 18A, in a first cross-sectional view.

Similar to the reflective surface 154 as discussed above with respect to FIG. 15A, the reflective surface 184 may be configured to face or to be oriented towards a primary signal reception direction 186 corresponding to the antenna 181. Additionally, the reflective surface 184 may be configured to reflect a communication signal associated with the antenna 181 in order to increase a directional gain of the antenna 181 in the primary signal reception direction 186, or the forward direction of the radiation pattern 180. The radiation pattern 180 may be associated with a forward gain bounded by a beam width 182.

By decreasing the second height 184H of the reflective surface 184 as compared to the first height 174H of the reflective surface 174, the performance of the radiation pattern 180 at the side of the reflecting plane in the positive "y" and negative "y" directions can be controlled or modified. For example, with comparison to the radiation pattern 170 illustrated in FIG. 17B, the beam width 182 of the radiation pattern 180 has a narrower angular range than the beam width 172.

A back lobe 188 may be associated with a peak backward gain 185 of the radiation pattern 180 in the backward direction (negative "x"). In the radiation pattern 180, it can be seen that the peak backward gain 185 is greater than the peak backward gain 175 of radiation pattern 170 (FIG. 17B). In addition to the back lobe 188 being larger as compared to the back lobe 178 of radiation pattern 170, it can be seen that the peak gain 185 in the primary signal reception direction 186 of the radiation pattern 180 is in the backward direction. Additionally, the forward gain 185 is slightly less than the backward gain associated with the back lobe 188.

FIG. 18C illustrates the example radiation pattern 180 of FIG. 18B, shown in a second cross-sectional view, normal to the first cross-sectional view.

The beam width 182 may have a directional component, such as the primary signal reception direction 186, in both the E-plane and H-plane of the radiation pattern. Additionally, the beam width 182 may have different angular ranges in the two cross-sectional views. In some examples, the angular range associated with the first cross-sectional view of FIG. 18B may be larger than the angular range associated with second cross-sectional view of FIG. 18C.

As the second width 184W of the reflective surface 184 is greater than the corresponding first width 174W of the reflective surface 174, the back lobe 188 is formed behind the E-plane. The second width 184W of the reflective surface 184 may be increased until the second width 184W is approximately equal to the second height 184H. In some examples, the second width 184W may be greater than the second height 184H.

Figure 19A:
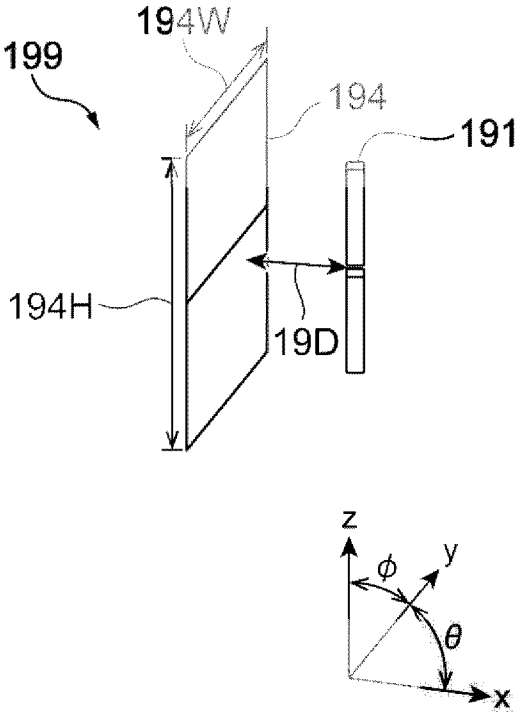
FIG. 19A illustrates an example antenna assembly including a reflective surface and an antenna.
Figure 19B:
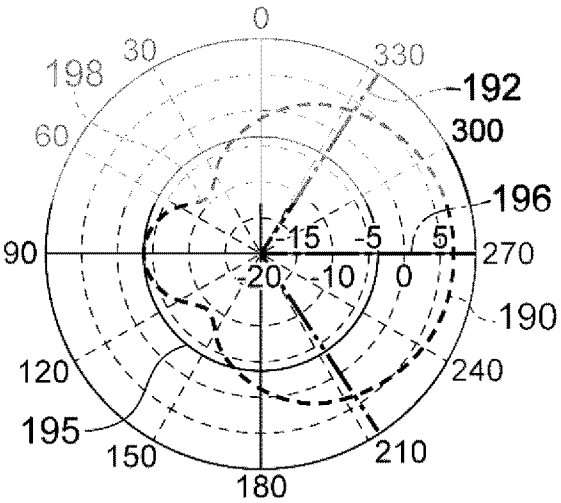
FIG. 19B illustrates an example radiation pattern for the antenna assembly of FIG. 19A, in a first cross-sectional view.

FIG. 19A illustrates an example antenna assembly 199 including a reflective surface 194 and an antenna 191, and FIG. 19B illustrates an example radiation pattern 190 for the antenna assembly 199 of FIG. 19A, in a first cross-sectional view. The reflective surface 194 includes a height 194H (first height) and a width 194W (first width). The antenna 191 may be spaced apart from the reflective surface 194 by a distance 19D.

The reflective surface 194 may be configured to face or to be oriented towards a primary signal reception direction 196 corresponding to the antenna 191. Additionally, the reflective surface 194 may be configured to reflect a communication signal associated with the antenna 191 in order to increase a directional gain of the antenna 191 in the primary signal reception direction 196, or the forward direction of the antenna radiation pattern 190. In some examples, the reflective surface 194 may be part of, or connected to, a second antenna of the antenna assembly 199.

The radiation pattern 190 may be associated with a forward gain bounded by a beam width 192. The beam width 192 may corresponding to a portion of the radiation pattern 190 which equals a percentage of, or standard deviation from, the peak value of the radiation pattern 190. In other examples, the beam width 192 may correspond to threshold gain value corresponding to a predetermined signal strength of the antenna 191, as measured in decibels (dB).

Figure 19C:
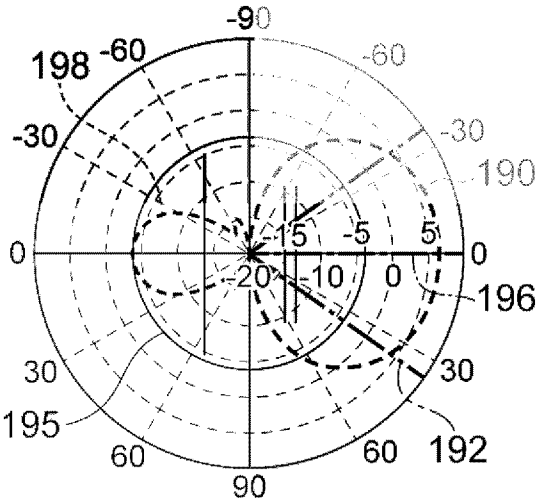
FIG. 19C illustrates the example radiation pattern of FIG. 19B, shown in a second cross-sectional view, normal to the first cross-sectional view.

FIG. 19C illustrates the example radiation pattern 190 of FIG. 19B, shown in a second cross-sectional view, normal to the first cross-sectional view. The beam width 192 may have a directional component, such as the primary signal reception direction 196, in both the E-plane and H-plane of the radiation pattern. Additionally, the beam width 192 may have different angular ranges in the two cross-sectional views. In some examples, the angular range associated with the first cross-sectional view of FIG. 19B may be larger than the angular range associated with second cross-sectional view of FIG. 19C.

Figure 20A:
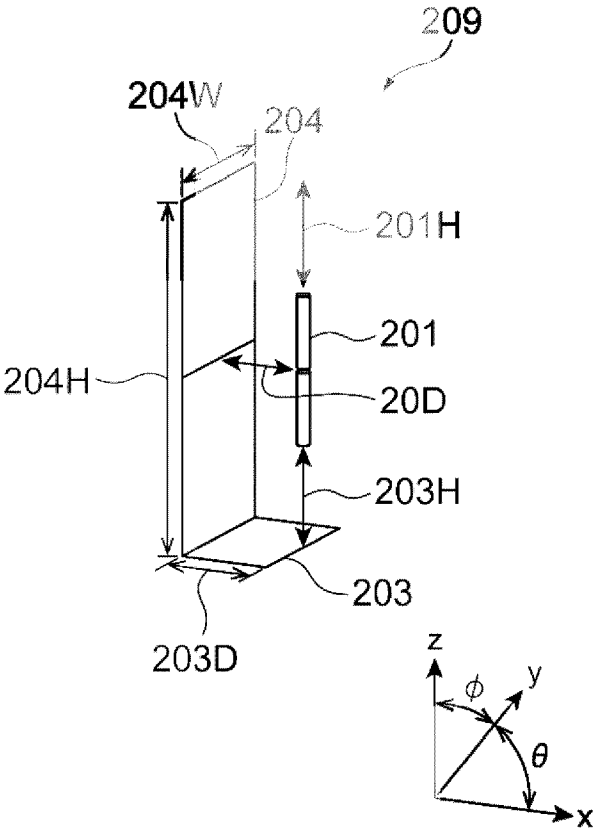
FIG. 20A illustrates an example antenna assembly including a lower signal receiving body.

FIG. 20A illustrates an example antenna assembly 209 including a reflective surface 204, a first antenna 201, and a lower signal receiving body 203. The reflective surface may include a width 204W (second width) and a height 204H (second height). In some examples, the second width 204W may the same width as the first width 194W of FIG. 19A, and the second height 204H may be the same height as the first height 194H. The first antenna 201 may be spaced apart from the reflective surface 204 by an antenna distance 20D. In some examples, a second antenna includes the lower signal receiving body 203 electrically coupled to the reflective surface 204.

The lower signal receiving body 203 may be formed substantially perpendicular to the reflective surface 204. In some examples, the lower signal receiving body 203 and the reflective surface 204 are the same width. The lower signal receiving body 204 may extend away from the reflective surface 204 by a distance 203D. In some examples, the lower signal receiving body 203 may extend by the distance 203D which is equal to or greater than the distance 20D between the first antenna 201 and the reflective surface 204, such that the lower signal receiving body 203 extends underneath the first antenna 201. The lower end of the first antenna 201 may be located at a distance 203H above the lower signal receiving body 203.

Figure 20B:
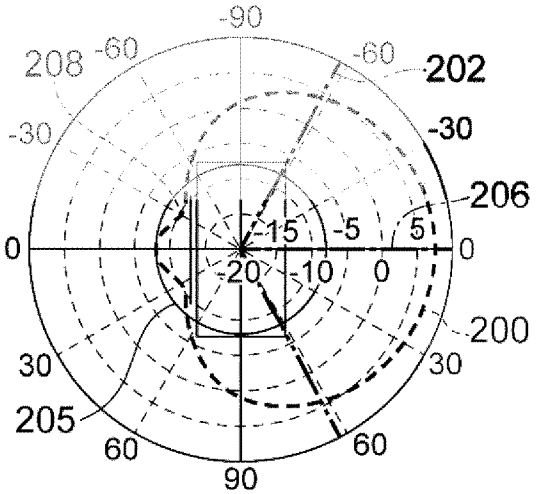
FIG. 20B illustrates an example radiation pattern for the antenna assembly of FIG. 20A, in a first cross-sectional view.

FIG. 20B illustrates an example radiation pattern 200 for the antenna assembly 209 of FIG. 20A, in a first cross-sectional view.

Similar to the reflective surface 154 as discussed above with respect to FIG. 15A, the reflective surface 204 may be configured to face or to be oriented towards a primary signal reception direction 206 corresponding to the first antenna 201. Additionally, the reflective surface 204 may be configured to reflect a communication signal associated with the first antenna 201 in order to increase a directional gain of the first antenna 201 in the primary signal reception direction 206, or the forward direction of the radiation pattern 200. The radiation pattern 200 may be associated with a forward gain bounded by a beam width 202.

By including the lower signal receiving body 203, the performance of the radiation pattern 200 at the side of the reflecting plane can be controlled or modified. For example, with comparison to the radiation pattern 190 illustrated in FIG. 19B, the beam width 202 of the radiation pattern 200 has a wider angular range than the beam width 192.

A back lobe 208 may be associated with a peak backward gain 205 of the radiation pattern 200 in the backward direction. In the radiation pattern 200, it can be seen that the peak backward gain 205 is less than the peak backward gain 195 of radiation pattern 190 (FIG. 198).

Figure 20C:
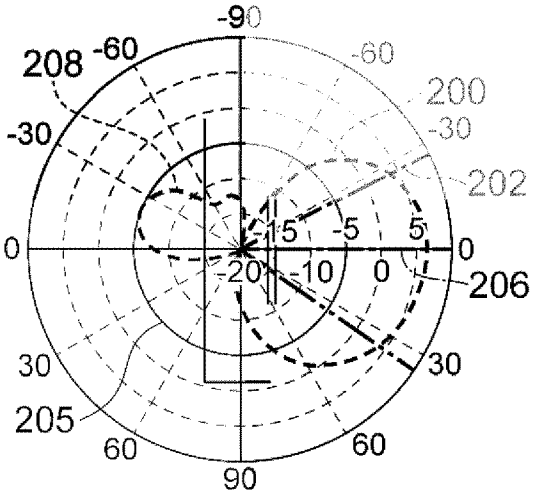
FIG. 20C illustrates the example radiation pattern of FIG. 20B, shown in a second cross-sectional view, normal to the first cross-sectional view.

FIG. 20C illustrates the example radiation pattern 200 of FIG. 20B, shown in a second cross-sectional view, normal to the first cross-sectional view.

By adding the lower signal receiving body 203 the radiation pattern 200 can be controlled in the H-plane. When the lower signal receiving body 203 extends underneath the first antenna 201, the radiation pattern 200 is shifted down in the H-plane. On the other hand, in some examples, by extending the lower signal receiving body 203 beyond the first antenna 201, the radiation pattern 200 may be shifted upwards in the H-Plane.

By decreasing the distance 203H or gap between the first antenna 201 and the lower signal receiving body 203, the radiation pattern 200 may be shifted further towards the bottom. In some examples, the radiation pattern 200 may shifted in the opposite direction when the antenna is lowered for antenna assemblies including a reflective surface without a lower signal receiving body, such as reflective surface 194 (FIG. 19A). In that case, by lowering the antenna 191, the radiation pattern 190 may be shifted upwards.

Figure 21C:
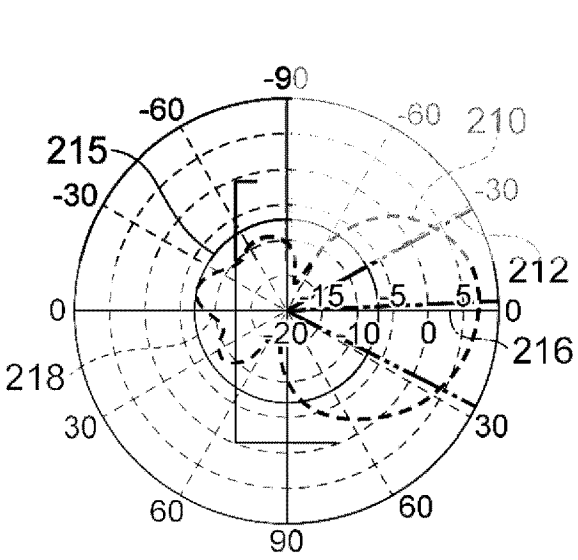
FIG. 21C illustrates the example radiation pattern of FIG. 21B, shown in a second cross-sectional view, normal to the first cross-sectional view.
Figure 21B:
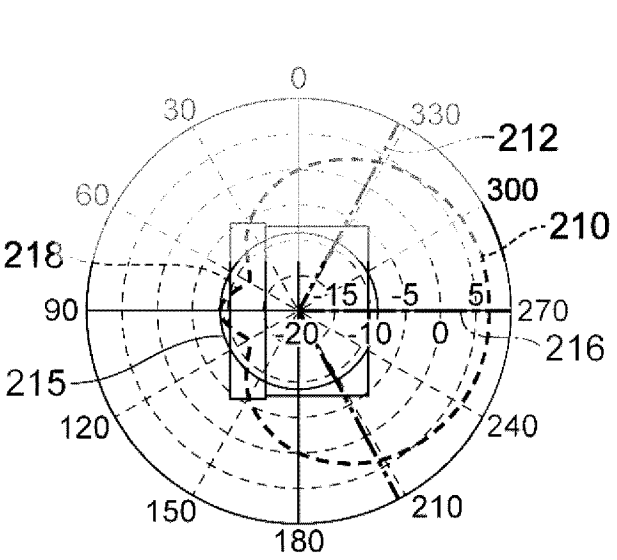
FIG. 21B illustrates an example radiation pattern for the antenna assembly of FIG. 21A, in a first cross-sectional view.
Figure 21A:
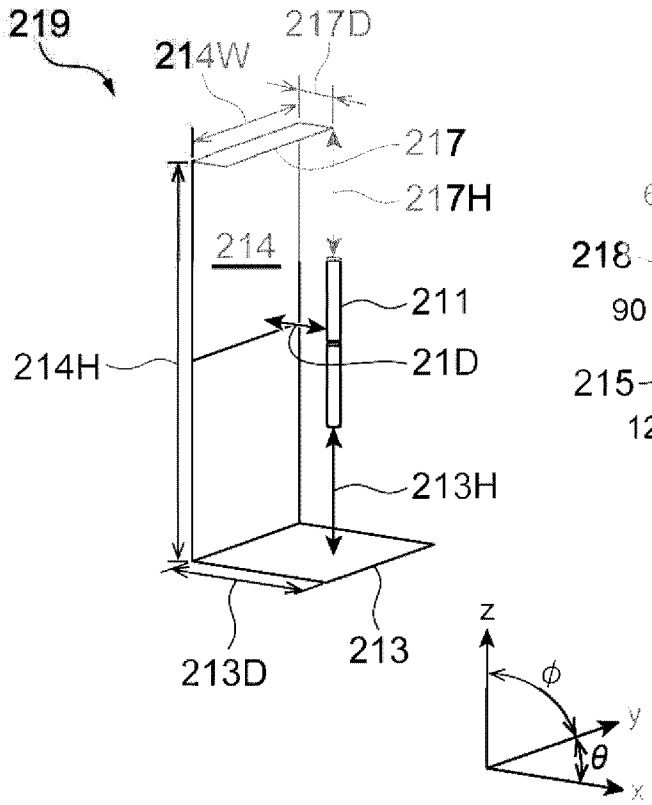
FIG. 21A illustrates an example antenna assembly including an upper signal receiving body.

FIG. 21A illustrates an example antenna assembly 219 including a reflective surface 214, a first antenna 211, a lower signal receiving body 213, and an upper signal receiving body 217. The reflective surface 214 may also comprise a signal receiving body. The first antenna 211 may be spaced apart from the reflective surface 214 by a distance 21D.

In some examples, a second antenna includes the upper signal receiving body 217 electrically coupled to the reflective surface 214, and the lower signal receiving body 213 may be electrically coupled to the reflective surface 214: The upper signal receiving body 217 may include a length 217D that extends away from the reflective surface 214 at an elevation 217H in the height direction which is higher than an upper end of the first antenna 211. The upper signal receiving body 217 and the upper end of the first antenna 211 may be spaced from each other in the height direction so as to electrically isolate the second signal receiving body 217 from the first antenna 211.

Additionally, the lower signal receiving body 213 may extend by a distance 213D which is equal to or greater than the distance 21D between the first antenna 211 and the reflective surface 214, such that the lower signal receiving body 213 extends underneath the first antenna 211. The lower signal receiving body 213 and the lower end of the first antenna 211 may be spaced apart from each other by an elevation 213H in the height direction so as to electrically isolate the lower signal receiving body 213 from the first antenna 211.

FIG. 21B illustrates an example radiation pattern 210 for the antenna assembly 219 of FIG. 21A, in a first cross-sectional view.

The reflective surface 214 may be configured to face or to be oriented towards a primary signal reception direction 216 corresponding to the first antenna 211. Additionally, the reflective surface 214 may be configured to reflect a communication signal associated with the first antenna 211 in order to increase a directional gain of the first antenna 211 in the primary signal reception direction 216, or the forward direction of the antenna radiation pattern 210. In some examples, the reflective surface 214 may be part of, or connected to, a second antenna of the antenna assembly 219.

The radiation pattern 210 may be associated with a forward gain bounded by a beam width 212. The beam width 212 may corresponding to a portion of the radiation pattern 210 which equals a percentage of, or standard deviation from, the peak value of the radiation pattern 210. In other examples, the beam width 212 may correspond to threshold gain value corresponding to a predetermined signal strength of the first antenna 211, as measured in decibels (dB).

FIG. 21C illustrates the example radiation pattern 210 of FIG. 21B, shown in a second cross-sectional view, normal to the first cross-sectional view.

The beam width 212 may have a directional component, such as the primary signal reception direction 216, in both the E-plane and H-plane of the radiation pattern. Additionally, the beam width 212 may have different angular ranges in the two cross-sectional views. In some examples, the angular range associated with the first cross-sectional view of FIG. 21B may be larger than the angular range associated with second cross-sectional view of FIG. 21C.

Figure 22C:
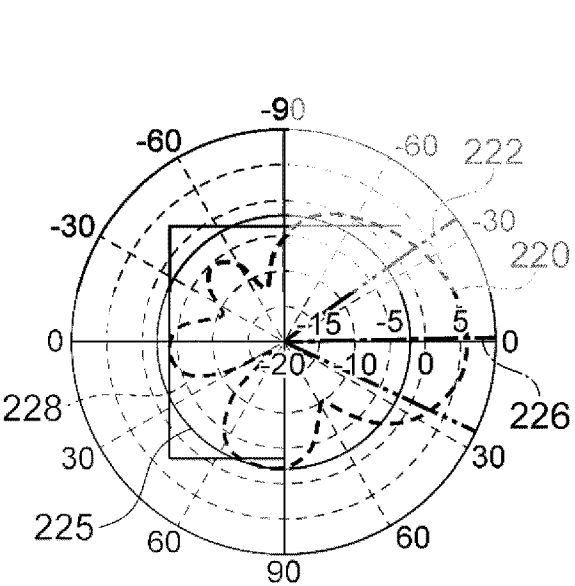
FIG. 22C illustrates the example radiation pattern of FIG. 22B, shown in a second cross-sectional view, normal to the first cross-sectional view.
Figure 22B:
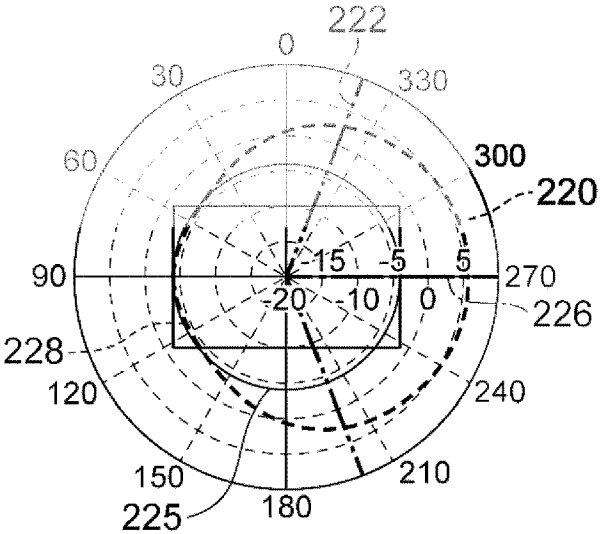
FIG. 22B illustrates an example radiation pattern for the antenna assembly of FIG. 22A, in a first cross-sectional view.
Figure 22A:
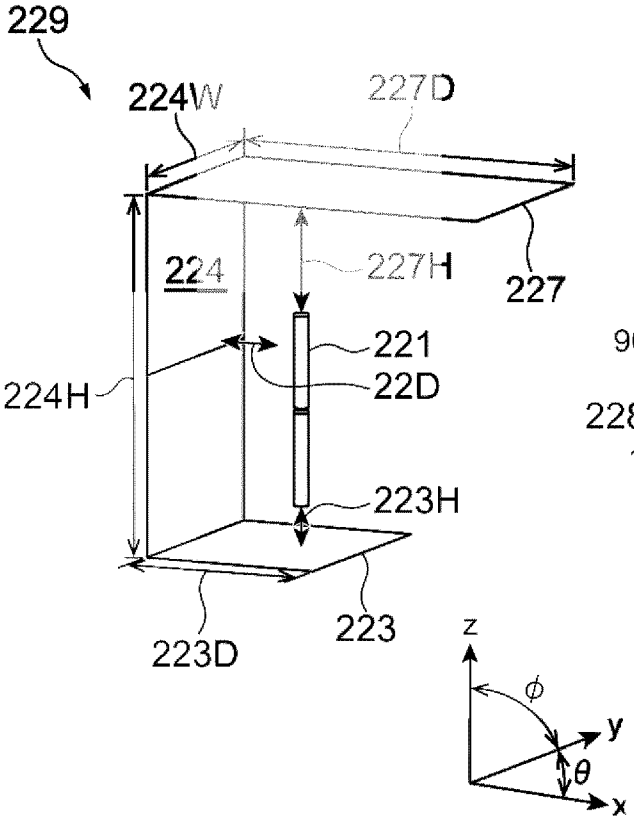
FIG. 22A illustrates an example antenna assembly including an upper signal receiving body having an extended length.

FIG. 22A illustrates an example antenna assembly 229 including a reflective surface 224, a first antenna 221, a lower signal receiving body 223, and an upper signal receiving body 227. The upper signal receiving body 227 of FIG. 22A has an extended length 227D as compared to the length 217D of the upper signal receiving body 217 of FIG. 21A. The first antenna 221 may be spaced apart from the reflective surface 224 by an antenna distance 22D.

In some examples, the spacing or gaps between the first antenna 221 and the upper and lower signal receiving bodies 223, 227 may be the same for both antenna assemblies 219 and 229. For example, an elevation 223H may be substantially equal to the elevation 213H, and an elevation 227H may be substantially equal to the elevation 217H. Still further, the antenna distance 22D may be substantially equal to the antenna distance 21D.

The length 227D of the upper signal receiving body 227 may be equal to or greater than the antenna distance 22D between the first antenna 221 and the reflective surface 224 so that the upper signal receiving body 227 extends directly above the upper end of the first antenna 221.

By adding one or both of the lower signal receiving body 223 and the upper signal receiving body 227, the performance and shape of the associated radiation pattern 220 may be controlled. Additionally, the lengths of the bodies and the spacing from the first antenna 221 may be varied to control the radiation pattern. Still further, the beam width size and direction may also be controlled as further described with respect to the following drawings.

FIG. 22B illustrates an example radiation pattern 220 for the antenna assembly 229 of FIG. 22A, in a first cross-sectional view.

Similar to the reflective surface 154 as discussed above with respect to FIG. 15A, the reflective surface 224 may be configured to face or to be oriented towards a primary signal reception direction 226 corresponding to the first antenna 221. Additionally, the reflective surface 224 may be configured to reflect a communication signal associated with the first antenna 221 in order to increase a directional gain of the first antenna 221 in the primary signal reception direction 226, or the forward direction of the radiation pattern 220. The radiation pattern 220 may be associated with a forward gain bounded by a beam width 222.

By including the lower signal receiving body 223, the performance of the radiation pattern 220 at the side of the reflecting plane can be controlled or modified. For example, with comparison to the radiation pattern 210 illustrated in FIG. 21B, the beam width 222 of the radiation pattern 220 has a wider angular range than the beam width 212.

A back lobe 228 may be associated with a peak backward gain 225 of the radiation pattern 220 in the backward direction. In the radiation pattern 220, it can be seen that the peak backward gain 225 is greater than the peak backward gain 215 of radiation pattern 210 (FIG. 21B).

FIG. 22C illustrates the example radiation pattern 220 of FIG. 22B, shown in a second cross-sectional view, normal to the first cross-sectional view. By extending the length 227D of the upper signal receiving body 227, the radiation pattern 220 can be further controlled in the H-plane. When the upper signal receiving body 227 extends above the first antenna 221, the radiation pattern 220 is shifted upward in the H-plane.

Figure 23B:
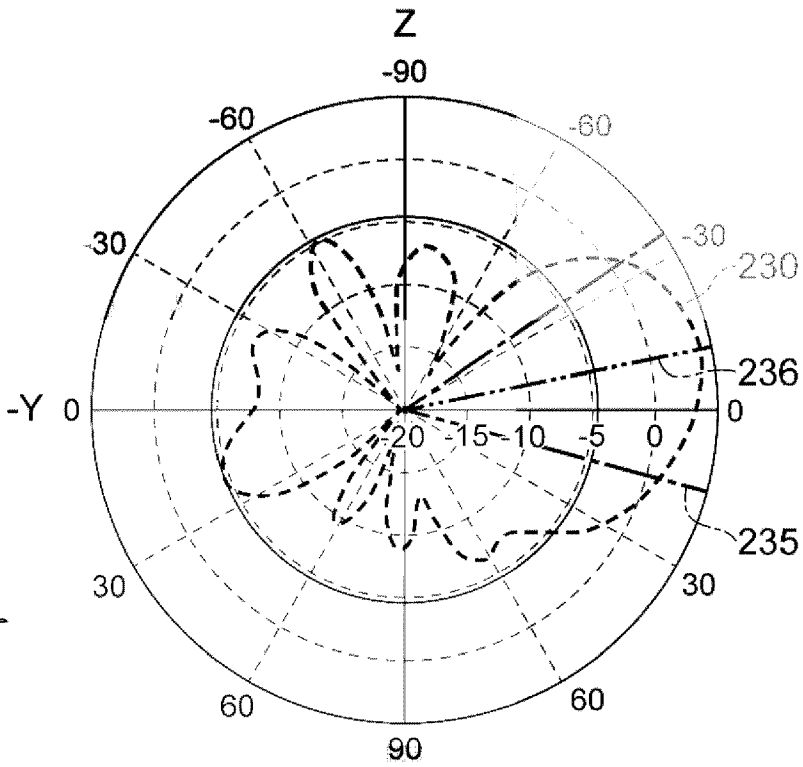
FIG. 23B illustrates a cross-sectional view of an example radiation pattern for the antenna assembly of FIG. 23A.
Figure 23A:
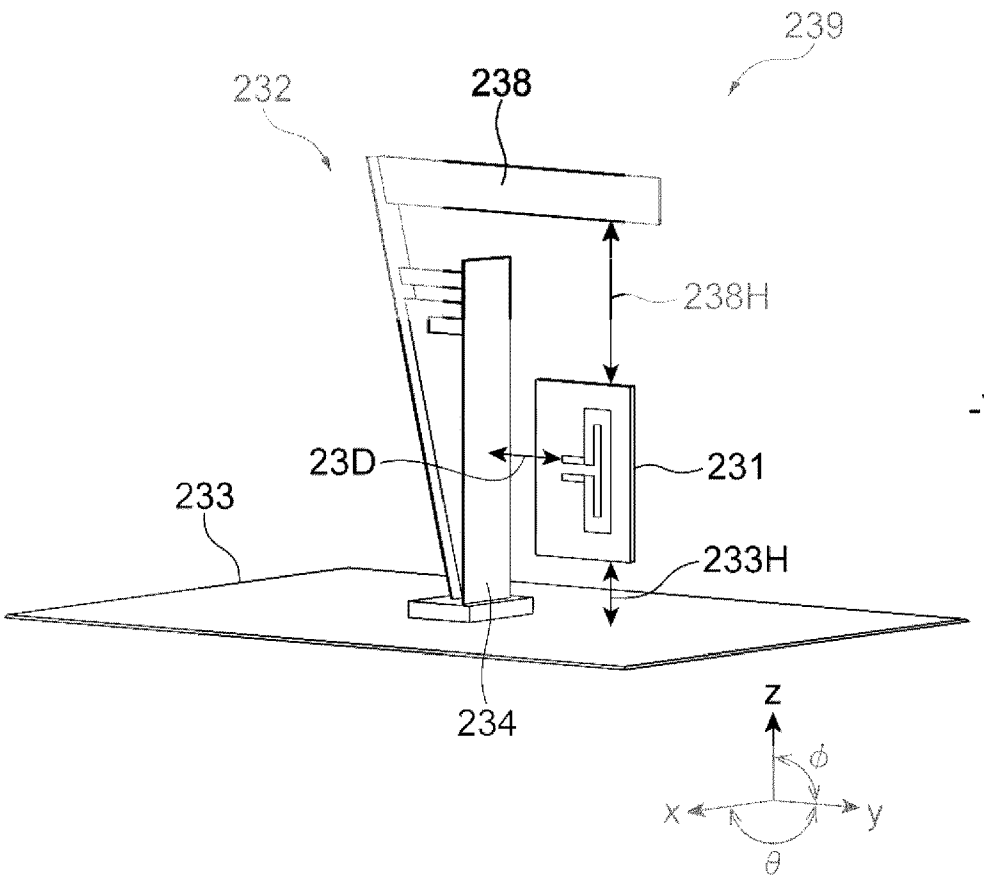
FIG. 23A illustrates an example antenna assembly.

FIG. 23A illustrates an example antenna assembly 239 including a first antenna 231 and a second antenna 232. The second antenna 232 includes a reflective surface 234 and an upper signal receiving body 238. The second antenna 232 may be located above a ground plane 233.

The first antenna 231 may be spaced apart from the reflective surface 234 by an antenna distance 23D. The top end of the first antenna 231 may be spaced apart from the upper signal receiving body 238 by a distance 238H. Additionally, the lower end of the first antenna 231 may be spaced apart from the ground plane 233 by a distance 233H.

FIG. 23B illustrates a cross-sectional view of an example radiation pattern 230 for the antenna assembly 239 of FIG. 23A.

The reflective surface 234 (FIG. 23A) may be configured to face or to be oriented towards a primary signal reception direction 236 corresponding to the first antenna 231. Additionally, the reflective surface 234 may be configured to reflect a communication signal associated with the first antenna 231 in order to increase a directional gain of the first antenna 231 in the primary signal reception direction 236, or the forward direction of the antenna radiation pattern 230.

The radiation pattern 230 may be associated with a forward gain bounded by a beam width 235 corresponding to a portion of the radiation pattern 230 which equals a percentage of, or standard deviation from, the peak value of the radiation pattern 230.

Figure 24B:
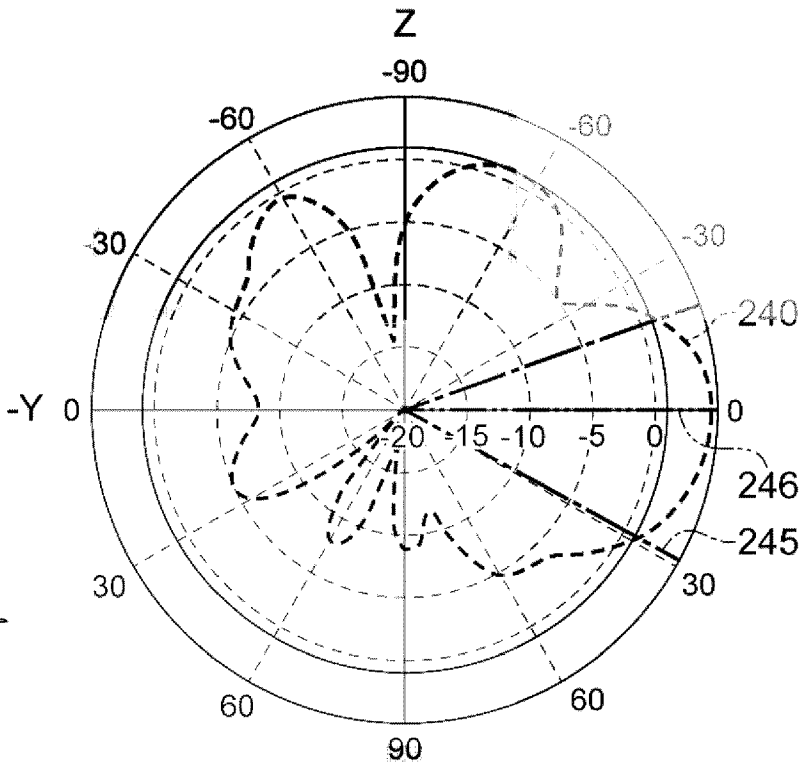
FIG. 24B illustrates a cross-sectional view of an example radiation pattern for the antenna assembly of FIG. 24A.
Figure 24A:
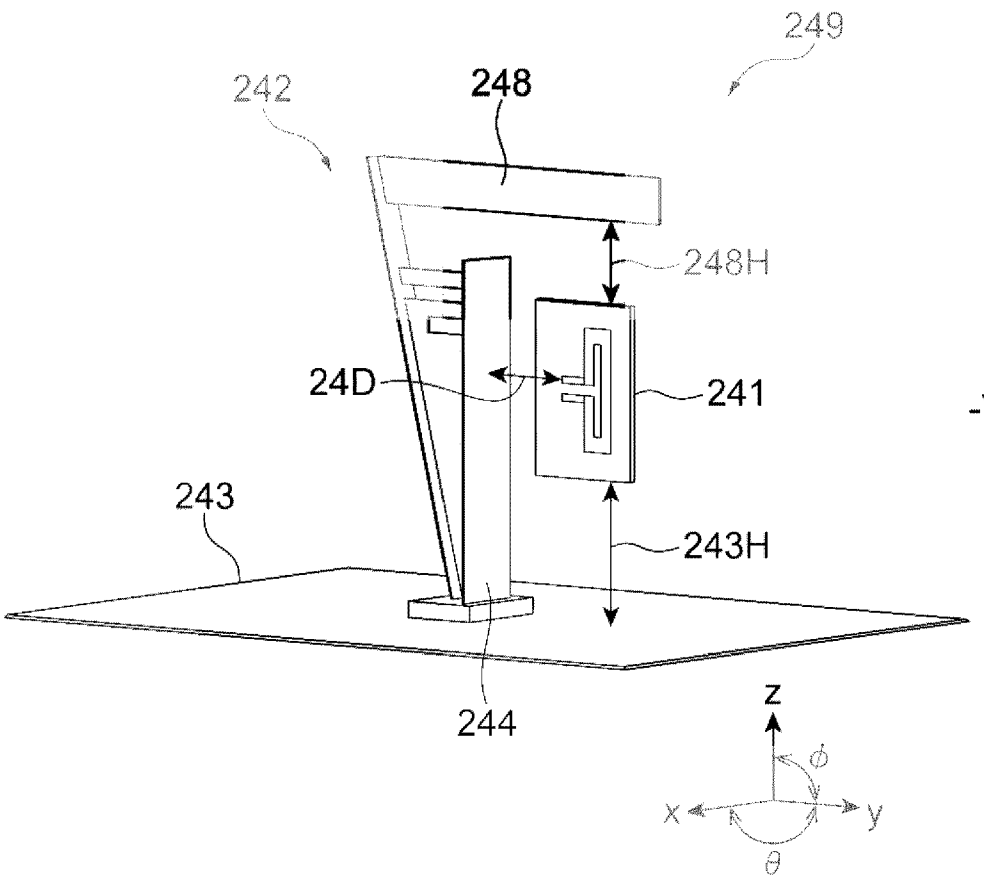
FIG. 24A illustrates another example antenna assembly.

FIG. 24A illustrates another example antenna assembly 249 including a first antenna 241 and a second antenna 242. The second antenna 242 includes a reflective surface 244 and an upper signal receiving body 248. The second antenna 242 may be located above a ground plane 243.

The first antenna 241 may be spaced apart from the reflective surface 244 by an antenna distance 24D. The top end of the first antenna 241 may be spaced apart from the upper signal receiving body 248 by a distance 248H. Additionally, the lower end of the first antenna 241 may be spaced apart from the ground plane 243 by a distance 243H.

Antenna distance 24D may be substantially equal to antenna distance 23D (FIG. 23A). In some examples, the first antenna 241 may be raised to a higher elevation corresponding to distance 243H as compared to distance 233H (FIG. 23A). At the same time, the distance 248H between the top end of the first antenna 241 and the upper signal receiving body 248 may be less than the distance 238H.

FIG. 24B illustrates a cross-sectional view of an example radiation pattern 240 for the antenna assembly 249 of FIG. 24A.

In comparing the radiation pattern 240 to radiation pattern 230 (FIG. 23B), it can be shown that by adjusting the height (distance 243H) of the first antenna 242 relative to the ground plane 243, the radiation pattern 240 may be controlled in the H-plane, along with the primary signal reception direction 246 and the beam width 245. In this case, the primary signal reception direction 246 is shifted downward as compared to the primary signal reception direction 236 (FIG. 23B).

By adjusting the height of the first antenna 241 relative to the ground plane 243, the radiation pattern in the E-Plane may also be controlled. On the other hand, the side performance (positive "x" to negative "x") of the radiation pattern can be controlled by varying the antenna distance 24D between the first antenna 242 and the reflective surface 244. Varying the antenna distance 24D may be also used to control the gain in the positive "y" direction.

Figure 25B:
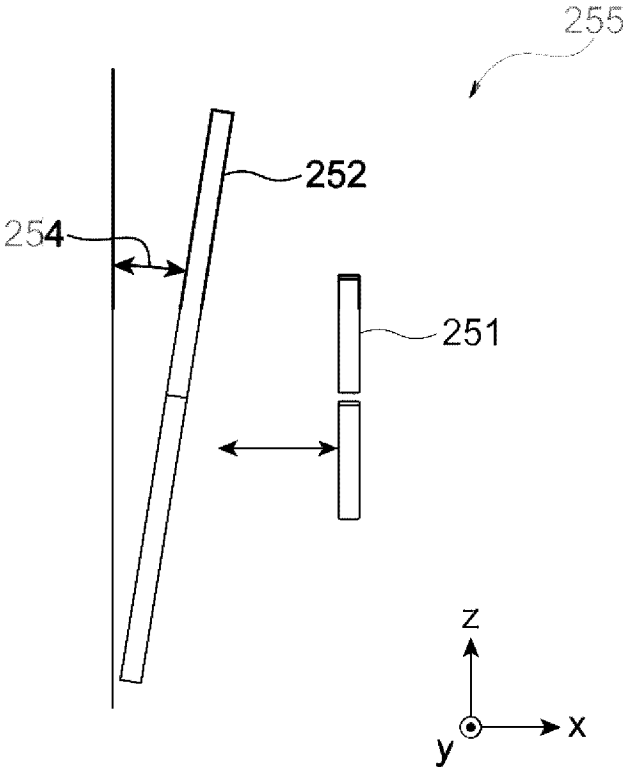
FIG. 25B illustrates an antenna assembly with an inclined reflective surface.
Figure 25A:
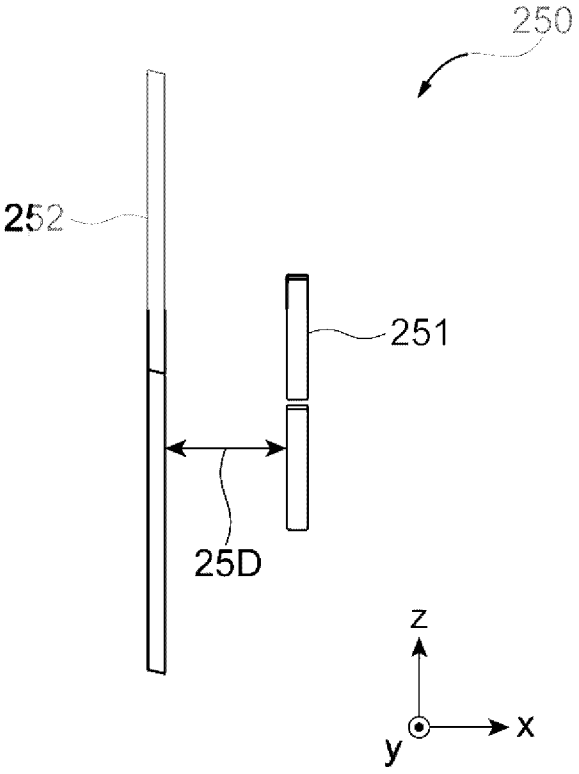
FIG. 25A illustrates yet another example antenna assembly.

FIG. 25A illustrates yet another example antenna assembly 250, including a first antenna 251 and a reflective surface 252. In some examples, the first antenna 251 may comprise a monopole antenna, a folded dipole antenna, or other type of antenna such as a metal plate, a metal wire, a metal rod, a round bar, a film, and a surface or layer of a printed circuit board (PCB). Additionally, the reflective surface 252 may be part of a second antenna. In some examples, the second antenna may comprise a metal plate, a metal wire, a metal rod, or a round bar. The first antenna 251 is spaced apart from the reflective surface 252 by an antenna distance 25D. The first antenna 251 and the reflective surface 252 are substantially parallel, such that the distance between the top end of the first antenna 251 to the reflective surface 252 is equal to the distance between the lower end of the first antenna 251 to the reflective surface 252.

FIG. 25B illustrates an antenna assembly 255 with the reflective surface 252 inclined by an angle 254. The first antenna 251 and the reflective surface 252 are non-parallel to each other, such that the distance between the top end of the first antenna 251 to the reflective surface 252 is less than the distance between the lower end of the first antenna 251 to the reflective surface 252. In other examples, the distance between the top end of the first antenna 251 to the reflective surface 252 may be greater than the distance between the lower end of the first antenna 251 to the reflective surface 252. By tilting the reflective surface 252 so that it is inclined with respect to the first antenna 251, the radiation pattern can be controlled in the H-plane.

In some examples, instead of or in addition to tilting the reflective surface 252, the reflective surface 252 may be rotated so as to be coplanar with the first antenna. With further reference to FIG. 2, the reflective surface 252 may be rotated ninety degrees so that the reflective surface 252 is coplanar with the first antenna (e.g., antenna 5) in the E-plane. Both sides of the reflective surface 252, in addition to the edge of the reflective surface 252 proximate to the first antenna, may therefore function to reflect signals corresponding to the first antenna.

Figure 26A:
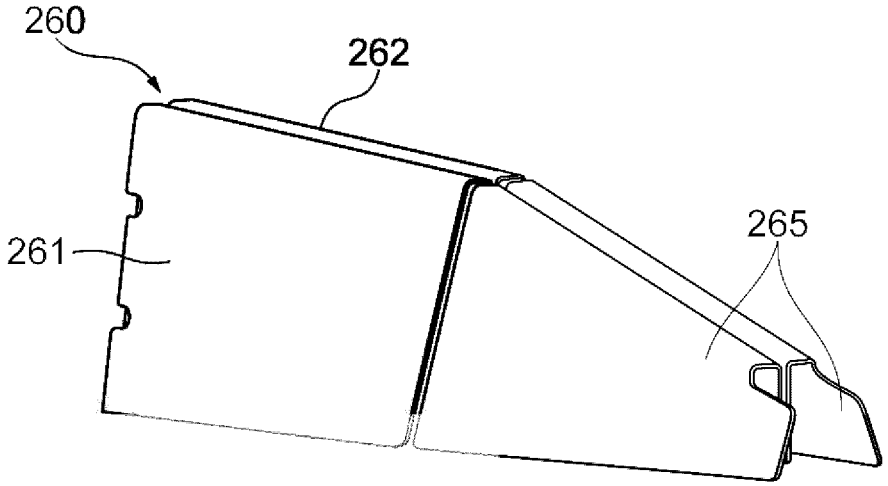
FIG. 26A illustrates an example signal receiving body for an antenna assembly.

FIG. 26A illustrates an example signal receiving body 260 for an antenna assembly, such as the antenna assembly 10 illustrated at FIG. 1. With further reference to FIG. 1, the signal receiving body 260 may include one or more tapered antenna elements that extend above the upper end of the first antenna 5. For example, the signal receiving body 260 may include a first set of elements 261, 262 located at a rear end of the signal receiving body 260. Additionally, the signal receiving body 260 may include a second set of elements 265 which extend above the upper end of the first antenna 5.

Figure 26B:
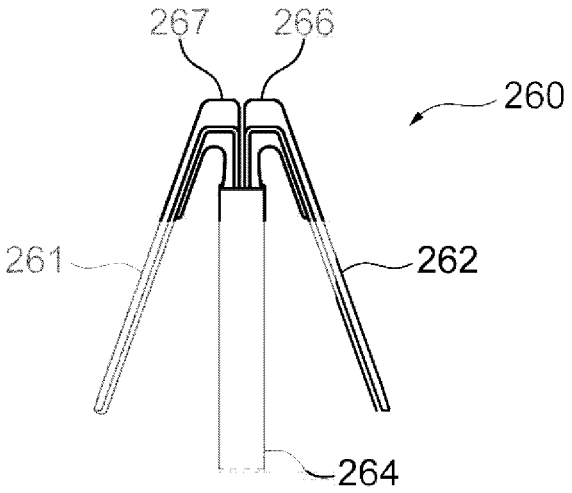
FIG. 26B illustrates a rear view of the signal receiving body of FIG. 26A.

FIG. 26B illustrates a rear view of the signal receiving body 260 of FIG. 26A, in which the first set of elements 261, 262 include one or more apexes 266, 267. In some examples, the signal receiving body 260 may include a holder 264 which may be connected to a second antenna, such as the second antenna 15 of FIG. 1. The shape of the signal receiving body 260 may include a tapered or umbrella shape to partially control a radiation pattern associated with the first antenna 5.

The signal receiving body 260 may be tapered, from the perspective of the rear view, from a narrow upper portion to a wider lower portion. In some examples, the narrow upper portion may be closed or connected, and the wider lower portion may be open. With further reference to FIG. 26B, the tapered shape of the first set of elements 261, 262 may form an angle in which the distance between the upper ends of the first set of elements 261, 262 may be less than the distance between the lower ends which are located on opposite sides of the reflective surface 264.

The signal receiving body 260 may comprise other shapes or types of tapered antenna elements, including an inverted-V shaped receiving body, a mountain type receiving body, a chevron shaped receiving body, and as further disclosed in U.S. Pat. No. 9,825,351, which is herein incorporated by reference in its entirety. Additionally, the signal receiving body 260 may be formed from a single sheet of metal or from a plurality of sheets, including one or more sheets having a meandering design and/or formed with one or more slits.

Figure 27:
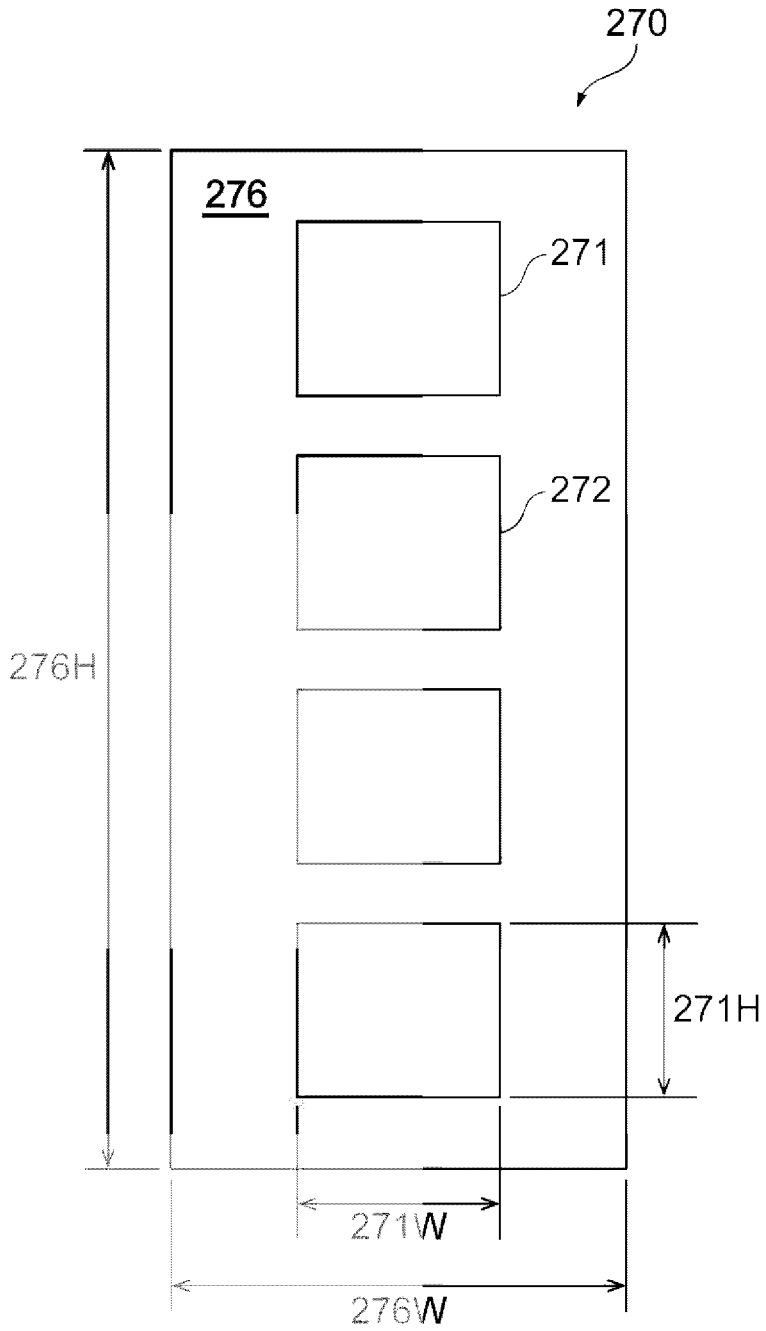
FIG. 27 illustrates an example reflective surface with holes.

FIG. 27 illustrates an example reflective surface 270 with a number of holes 271, 272. The reflective surface 270 may include a height 276H and a width 276W. In some examples, the number of holes 271, 272 are linearly oriented in the height direction.

The holes 271, 272 may also be associated with a height 271H and a width 271W. The number and size of the holes may be configured both to control the shape of the radiation pattern associated with an antenna (such as the first antenna 5 of FIG. 1) and to decrease a weight of the reflective surface. In some examples, the reflective surface 270 may form part of a second antenna, such as the second antenna 15 of FIG. 1.

Figure 28:
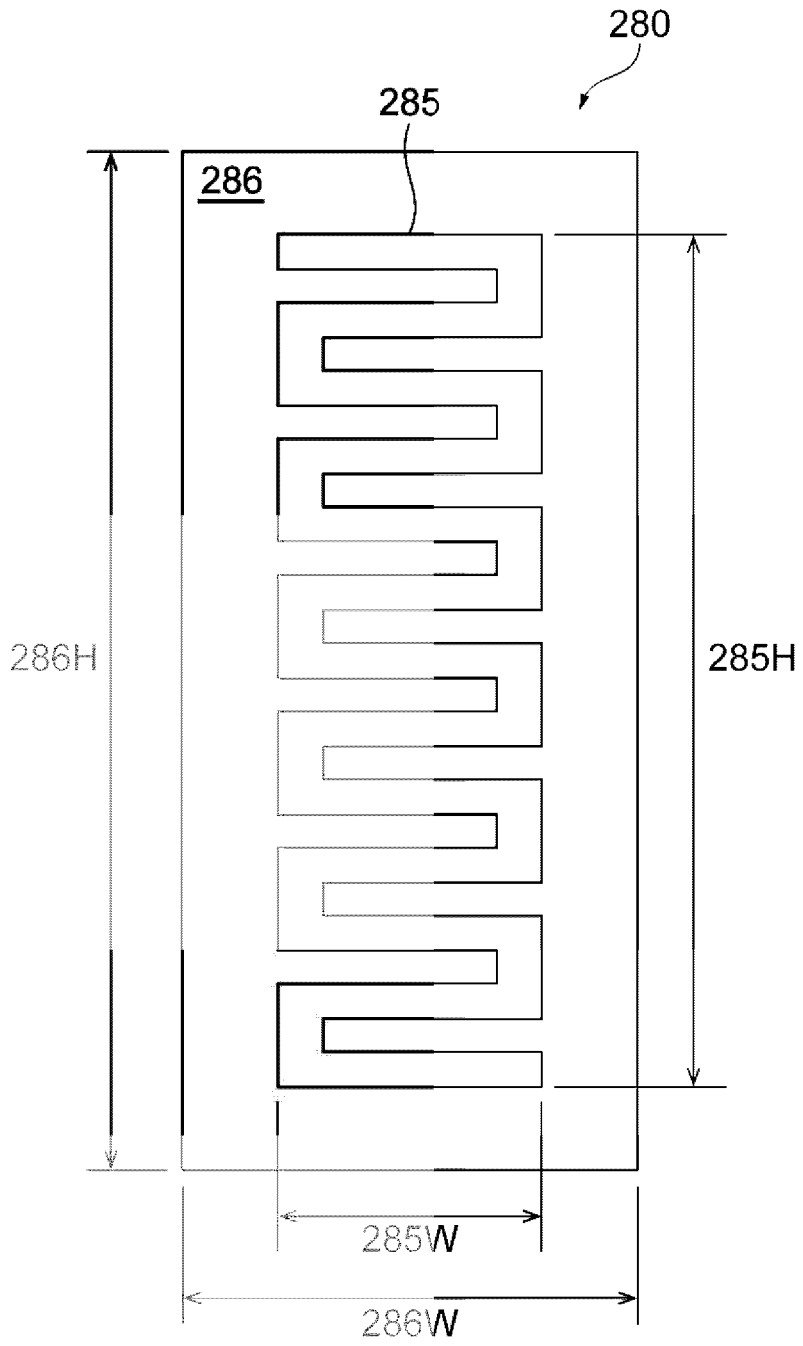
FIG. 28 illustrates another example reflective surface with a meandering serpentine structure.

FIG. 28 illustrates another example reflective surface 280 with a meandering serpentine structure 285. The reflective surface 280 may form part of a second antenna, such as the second antenna 15 of FIG. 1, and may include a reflective pattern etched or otherwise formed on a substrate 286. The reflective pattern may include the serpentine structure 285. In other examples, the serpentine structure 285 may be cut out of or otherwise removed from the substrate 286, in which case the substrate 286 may be configured to reflect signals.

The serpentine structure 285 may be associated with a height 285H and a width 285W. In some examples, the height 285H and the width 285W may be less than the height 286H and the width 286W, respectively, of the substrate 286. The height 285H, width 285W, and number of turns of the serpentine structure 285 may be varied in order to control a radiation pattern associated with an antenna, such as the first antenna 5 of FIG. 1.

It is to be understood that not all aspects, advantages and features described herein may necessarily be achieved by, or included in, any one particular example embodiment. Indeed, having described and illustrated various examples herein, it should be apparent that other examples may be modified in arrangement and detail.

Whereas certain examples described herein may be understood to operate with V2X technologies, in other examples one or more antennas may be configured to receive signals and/or control radiation patterns associated with frequency modulation (FM), amplitude modulation (AM), digital audio broadcasting (DAB), digital television (DTV), telephone, cellular, other types of transmissions, or any combination thereof.

In some example antenna assemblies, such as those including a V2X antenna, the antenna components may be configured to primarily increase the gain in one direction of the desired radiation pattern to cover at least half of the desired radiation pattern. This may assume, for example, that another antenna will cover the other half of the desired radiation pattern.

The antenna gain may be increased by using a reflector from a cellular antenna, for example, that resides in the same housing as the V2X antenna. Other types of antenna combinations may include Wi-Fi and Cellular, for example. The antenna assembly with reflective surface may be configured for a roof mount vehicle package that contains more than one antenna. However, one or more of the examples discloses herein may also be used for other applications, such as hidden antennas inside the vehicle, for glass antennas in the glass of the vehicle, or in non-automotive antenna applications where more than two antennas are in the same package.

In addition to 4G/5G and V2X antenna assemblies, one or more of the examples disclosed herein may be used with other types, and other combinations of different antennas.

We claim all modifications and variations coming within the spirit and scope of the subject matter claimed herein.

We claim:

1. An antenna assembly, comprising:

a first antenna having a first length in a height direction; and a second antenna including a reflective surface having a second length in the height direction greater than the first length, wherein the reflective surface of the second antenna is oriented towards a primary signal reception direction of the first antenna, and wherein the reflective surface is configured to reflect a communication signal associated with the first antenna in order to increase a directional gain of the first antenna in the primary signal reception direction.

2. The antenna assembly of claim 1, wherein the second antenna comprises a signal receiving body that is offset from the reflective surface.

3. The antenna assembly of claim 2, wherein the signal receiving body is angularly offset from the reflective surface along a vertically oriented plane formed perpendicular to the reflective surface, and wherein the reflective surface is located between the signal receiving body and the first antenna along the vertically oriented plane.

4. The antenna assembly of claim 2, wherein the second antenna comprises a second signal receiving body electrically coupled to the signal receiving body, the second signal receiving body extending from the signal receiving body at an elevation in the height direction which is higher than an upper end of the first antenna.

5. The antenna assembly of claim 4, wherein the second signal receiving body and the upper end of the first antenna are spaced from each other in the height direction so as to electrically isolate the second signal receiving body from the first antenna.

6. The antenna assembly of claim 4, wherein a length of the second signal receiving body is equal to or greater than a distance between the first antenna and the reflective surface in the primary signal reception direction so as to extend directly above the upper end of the first antenna.

7. The antenna assembly of claim 4, wherein the second signal receiving body comprises a tapered antenna element that extends above the upper end of the first antenna.

8. The antenna assembly of claim 4, wherein the second antenna further comprises a third signal receiving body electrically coupled to the signal receiving body, the third signal receiving body extending from the signal receiving body at an elevation in the height direction which is below a lower end of the first antenna.

9. The antenna assembly of claim 8, wherein the third signal receiving body and the lower end of the first antenna are spaced from each other in the height direction so as to electrically isolate the third signal receiving body from the first antenna.

10. The antenna assembly of claim 8, wherein a length of the third signal receiving body is equal to or greater than a distance between the first antenna and the reflective surface in the primary signal reception direction so as to extend directly underneath the lower end of the first antenna.

11. The antenna assembly of claim 2, wherein the signal receiving body is electrically coupled to the reflective surface to form a multiband antenna, and wherein the signal receiving body and the reflective surface have different effective antenna lengths.

12. The antenna assembly of claim 1, further comprising an antenna housing at least partially located above the first antenna and the second antenna in the height direction, wherein the first antenna and the second antenna are spatially separated from each other along the primary signal reception direction, and wherein the primary signal reception direction is substantially perpendicular to the height direction.

13. An antenna assembly, comprising:

a first antenna having a first length in a height direction, the first antenna configured to receive a first communication signal having a first frequency; and a second antenna including a reflective surface having a second length in the height direction equal to or greater than the first length, the second antenna configured to receive a second communication signal having a second frequency which is lower than the first frequency, wherein the reflective surface of the second antenna is oriented towards a primary signal reception direction of the first antenna, and wherein the reflective surface is configured to reflect the first communication signal in order to increase a directional gain of the first antenna in the primary signal reception direction.

14. The antenna assembly of claim 13, wherein the first communication signal associated with the first antenna has a primary signal wavelength, and wherein a distance between the first antenna and the reflective surface in a direction perpendicular to the height direction is equal to or less than approximately one half of the primary signal wavelength.

15. The antenna assembly of claim 13, wherein the first antenna comprises a vehicle-to-everything antenna, and wherein the second antenna comprises a resonance antenna selected from the group of antennas consisting of a radio antenna, a telecommunications antenna, and a digital audio broadcast antenna.

16. The antenna assembly of claim 15, wherein the first antenna comprises a folded dipole antenna.

17. The antenna assembly of claim 15, wherein the first antenna is formed on a vertically oriented antenna substrate surface in the height direction, and wherein the antenna substrate surface is positioned substantially perpendicular to the reflective surface.

18. The antenna assembly of claim 13, wherein the reflective surface of the second antenna comprises a number of holes linearly oriented in the height direction.

19. The antenna assembly of claim 13, wherein the reflective surface of the second antenna comprises a reflective pattern formed on a substrate, and wherein the reflective pattern comprises a meandering serpentine structure.

20. The antenna assembly of claim 13, further comprising an antenna housing attached to a vehicle mounting structure, wherein the height direction extends away from the vehicle mounting structure, and wherein both the first antenna and the second antenna including the reflective surface are located in the antenna housing.

* * * * *